US012359893B2

(12) United States Patent
Jakstas

(10) Patent No.: US 12,359,893 B2
(45) Date of Patent: Jul. 15, 2025

(54) RAIL SYSTEM FOR A FIREARM

(71) Applicant: JAK TECHNOLOGIES PTY LTD, Ashmore (AU)

(72) Inventor: Daniel Jakstas, Southport (AU)

(73) Assignee: JAK Technologies Pty Ltd., Maudsland (AU)

( * ) Notice: Subject to any disclaimer, the term of this patent is extended or adjusted under 35 U.S.C. 154(b) by 122 days.

(21) Appl. No.: 18/282,043

(22) PCT Filed: Mar. 16, 2022

(86) PCT No.: PCT/AU2022/050227
§ 371 (c)(1),
(2) Date: Sep. 14, 2023

(87) PCT Pub. No.: WO2022/192949
PCT Pub. Date: Sep. 22, 2022

(65) Prior Publication Data

US 2024/0302135 A1 Sep. 12, 2024

(30) Foreign Application Priority Data

Mar. 16, 2021 (AU) ..... 2021900755

(51) Int. Cl.
*F41G 11/00* (2006.01)
*F41C 23/16* (2006.01)
*F41C 27/00* (2006.01)

(52) U.S. Cl.
CPC ..... *F41G 11/003* (2013.01); *F41C 23/16* (2013.01); *F41C 27/00* (2013.01)

(58) Field of Classification Search
CPC ..... F41G 11/003; F41C 23/16; F41C 27/00
See application file for complete search history.

(56) References Cited

U.S. PATENT DOCUMENTS 3,559,940 A * 2/1971 Kruzell ..... F41G 11/001 248/223.41
4,205,473 A 6/1980 Wilson
(Continued)

OTHER PUBLICATIONS

International Search Report and Written Opinion for International Application No. PCT/AU2022/050227 dated May 12, 2022.

*Primary Examiner* — Michelle Clement
(74) *Attorney, Agent, or Firm* — Potomac Law Group, PLLC; Joseph F. Murphy

(57) ABSTRACT

A rail system for a firearm includes an elongate body that is fastenable to the firearm to at least partially enclose a barrel of the firearm. A series of substantially parallel mounting ribs projects laterally from the elongate body. Each mounting rib has an outward facing surface and opposed sides that taper towards each other from the outward facing surface to the elongate body, such that a space between consecutive mounting ribs converges from the elongate body to the outward facing surfaces of the mounting ribs. A mounting assembly includes at least one connector receivable in a space between consecutive mounting ribs. A fastening mechanism is operable to secure the connector to the mounting ribs or to release the connector from the mounting ribs for infinite adjustment. A mount is arranged on the connector(s). The mount is configured for releasable connection to an ancillary device.

17 Claims, 13 Drawing Sheets

(56) References Cited

U.S. PATENT DOCUMENTS

| | | | | |
|---|---|---|---|---|
| 5,425,191 | A * | 6/1995 | Taylor | F41G 11/001 42/124 |
| 8,136,287 | B2 * | 3/2012 | Adams | F41G 11/001 403/325 |
| 10,041,765 | B2 * | 8/2018 | McMakin | F41G 1/38 |
| 12,203,728 | B2 * | 1/2025 | Lindsay | F41G 11/003 |
| 2012/0124880 | A1 | 5/2012 | Leclair | |
| 2012/0227304 | A1 | 9/2012 | Engelhardt | |
| 2013/0031820 | A1 | 2/2013 | Deros | |
| 2018/0164078 | A1 | 6/2018 | Hancosky | |

* cited by examiner

RAIL SYSTEM FOR A FIREARM

FIELD OF THE INVENTION

This invention relates to a rail system and a to handguard for a firearm.

BACKGROUND TO THE INVENTION

Firearms, such as assault rifles and replicas of assault rifles for recreational use, often require the mounting of attachments or ancillary devices, in addition to the usual iron or telescopic sights. For example, ancillary devices, such as laser sighting systems, illuminators and foregrips can be required to be mounted on an assault rifle or a replica. In this specification, the term "firearm" is used broadly and encompasses recreational weapons, such as gas-operated firearms and automatic electric guns, gel blasters or airsoft guns that are often replicas of assault rifles.

In order to achieve the selective mounting of ancillary devices on such assault rifles, use is made of what is known as a rail system. A rail system includes a body, usually in the form of a handguard, that is releasably fastenable to a receiver of the assault rifle. A rail, such as a picatinny rail, may run along the top of the body or handguard. Thus, in this specification, the term "rail system" is to be understood to include, generally, at least a handguard and, optionally, a rail that runs along the top of the handguard. The rail and the handguard are usually in the form of a one-piece structure.

The rail usually includes a mount that allows an ancillary device to be mounted on the rail and to be linearly adjustable along a length of the rail. In transverse cross section, the mount has a head which is undercut, allowing the ancillary device or attachment, having a complementary mount, to be slid onto the rail and slidably positioned. The head defines a series of equally spaced slots that allow the ancillary device or attachment to be secured or locked in position once it has been positionally adjusted.

Current rail systems have predesignated areas, on the handguard, in which to mount the ancillary devices, usually in the form of a cut out section into which the ancillary device locks. A problem with such an arrangement is that positions of the ancillary devices on the handguard are constrained according to the position of predesignated areas. This limits personalisation of the way the firearm is held, and the way attachments or ancillary devices are used. This can have a deleterious effect on the ergonomics of the firearm. Operators have different grips, hand sizes, arm lengths, et cetera. Thus, having the ancillary devices in predetermined positions does not allow for customisation to suit the operators. Given the nature of the work carried out by the operators, it is highly desirable that operators be able to customise the position of the ancillary devices to suit their particular characteristics and operating requirements.

An example of a rail system is that described in United States Patent Publication US2018/0058808A1. This publication describes a handguard assembly that comprises a handguard configured to overlie a barrel of the firearm in spaced relationship, the handguard comprising a plurality of apertures. A rail segment includes a plurality of mounting bosses, each of the plurality of mounting bosses is located in a different one of the plurality of apertures of the handguard. A plurality of rotatable fasteners fasten the rail segment to the handguard. Each of the rotatable fasteners is located in a different one of the mounting bosses of the rail segment. Each of the rotatable fasteners comprises a mounting latch to mount the rail segment to the handguard. See the Abstract of this publication. It will be appreciated that positioning of the rail segment is constrained by the number and position of the plurality of apertures. Thus, the number and position of ancillary devices that can be attached to the rail system is also so constrained.

SUMMARY OF THE INVENTION

According to a first aspect of the invention, there is provided a rail system for a firearm, the rail system comprising:

- an elongate body that is fastenable to the firearm to at least partially enclose a barrel of the firearm;
- a series of substantially parallel mounting ribs projecting laterally from the elongate body, each mounting rib having an outward facing surface and opposed sides that taper towards each other from the outward facing surface to the elongate body, such that a space between consecutive mounting ribs converges from the elongate body to the outward facing surfaces of the mounting ribs; and
- at least one mounting assembly for an attachment or ancillary device for the firearm, the, or each, mounting assembly including:
  - at least one connector that is receivable in one of the spaces between the consecutive mounting ribs;
  - a fastening mechanism operatively engaged with the, or each respective, connector, and operable to secure the connector to the consecutive mounting ribs or to release the connector from the mounting ribs for infinite adjustment of a position of the connector in the space between the consecutive ribs; and
  - a mount arranged on the, or each, connector, the mount being configured for releasable connection to the attachment or ancillary device.

The elongate body may be tubular.

An elongate mount may be arranged longitudinally on the elongate body and may project laterally or outwardly from the elongate body.

The ribs may extend from at or near each side of the mount and at least partially about the elongate body.

The, or each, connector and the ribs may be dimensioned so that the connector is inhibited from lateral movement out of the space between the consecutive ribs.

The, or each, connector may include a body that has opposed side faces, top and bottom faces and opposed proximal and distal faces, the proximal and distal faces being planar and extending angularly away from each other from the top face to the bottom face, with the proximal and distal faces being complementary with the side of each mounting rib so that outward displacement of the connector from a loosened or released position to a fastened or secured position results in the proximal and distal faces bearing against facing sides of the consecutive mounting ribs such that, in the loosened position, the connector can slide between the consecutive mounting ribs, and, in the fastened condition, sliding of the connector between the consecutive mounting ribs is inhibited.

The fastening mechanism may engage the mount and the, or each, connector, and may be operable to displace the, or each, connector outwardly and towards the mount into the fastened condition, and away from the mount into the loosened position.

The, or each, connector mat define a threaded opening and the mount may define at least one passage that corresponds with the threaded opening, the fastening mechanism including at least one threaded fastener that is receivable through the, or each respective, passage and into the threaded opening to engage the connector so that tightening rotation of the fastener serves to draw the connector towards the mount, into the fastened condition, so that the proximal and distal faces of the connector bear against the facing sides of the consecutive mounting ribs and loosening rotation of the fastener releases the proximal and distal faces of the connector from the facing sides, into the released condition.

The mount may be in the form of an elongate rail segment.

The tubular body may be cylindrical.

The rail system may include a cylindrical barrel nut that can be screwed onto a receiver of the firearm, a proximal end portion of the tubular body being fastenable to the cylindrical barrel nut.

The cylindrical barrel nut may include at least one radially extending threaded opening and the proximal end portion of the tubular body may define at least one respective corresponding opening so that the tubular body can be secured to the barrel nut with a suitable threaded fastener.

The tubular body may include an anti-twist mechanism to engage with a receiver of the firearm so as to inhibit excessive twisting of the tubular body relative to the receiver.

The anti-twist mechanism may include two anti-twist projections that extend from a proximal end of the tubular body to be positioned on either side of a rail of the receiver.

According to a second aspect of the invention, there is provided a rail system for a firearm, the rail system comprising:

an elongate body that is fastenable to the firearm to at least partially enclose a barrel of the firearm; and a series of substantially parallel mounting ribs projecting laterally from the elongate body, each mounting rib having an outward facing surface and opposed sides that taper towards each other from the outward facing surface to the elongate body, such that a space between consecutive mounting ribs converges from the elongate body to the outward facing surfaces of the mounting ribs, a connector of a mounting assembly for an attachment or ancillary device for the firearm being receivable in one of the spaces between the consecutive mounting ribs, the mounting assembly including a fastening mechanism operatively engaged with the connector and operable to secure the connector to the consecutive mounting ribs or to release the connector from the mounting ribs for infinite adjustment of a position of the connector in the space between the consecutive ribs, with a mount of the mounting assembly arranged on each connector, the mount being configured for releasable connection to the attachment or ancillary device.

According to a third aspect of the invention, there is provided a handguard for a firearm, the handguard comprising:

an elongate body that is fastenable to the firearm to at least partially enclose a barrel of the firearm;

a series of substantially parallel mounting ribs projecting laterally from the elongate body, each mounting rib having an outward facing surface and opposed sides that taper towards each other from the outward facing surface to the elongate body, such that a space between consecutive mounting ribs converges from the elongate body to the outward facing surfaces of the mounting ribs; and at least one mounting assembly for an attachment or ancillary device for the firearm, the, or each, mounting assembly including:

at least one connector that is receivable in one of the spaces between the consecutive mounting ribs;

a fastening mechanism operatively engaged with the, or each respective, connector, and operable to secure the connector to the consecutive mounting ribs or to release the connector from the mounting ribs for infinite adjustment of a position of the connector in the space between the consecutive ribs; and a mount arranged on the, or each, connector, the mount being configured for releasable connection to the attachment or ancillary device.

According to a fourth aspect of the invention, there is provided a handguard for a firearm, the handguard comprising:

an elongate body that is fastenable to the firearm to at least partially enclose a barrel of the firearm; and a series of substantially parallel mounting ribs projecting laterally from the elongate body, each mounting rib having an outward facing surface and opposed sides that taper towards each other from the outward facing surface to the elongate body, such that a space between consecutive mounting ribs converges from the elongate body to the outward facing surfaces of the mounting ribs, a connector of a mounting assembly for an attachment or ancillary device for the firearm being receivable in one of the spaces between the consecutive mounting ribs, the mounting assembly including a fastening mechanism operatively engaged with the connector and operable to secure the connector to the consecutive mounting ribs or to release the connector from the mounting ribs for infinite adjustment of a position of the connector in the space between the consecutive ribs, with a mount of the mounting assembly arranged on each connector, the mount being configured for releasable connection to the attachment or ancillary device.

DETAILED DESCRIPTION

Figures 1, 1A:
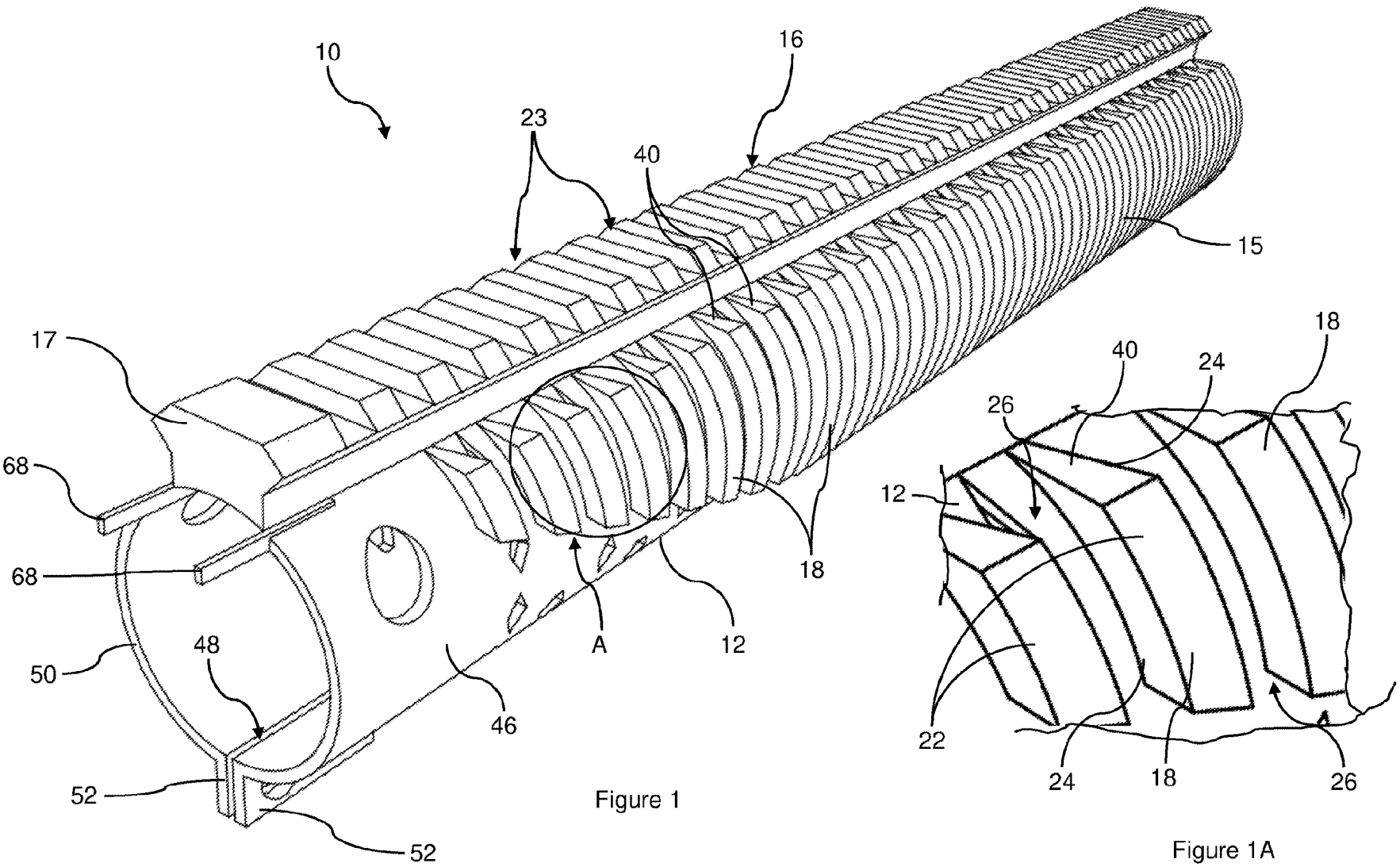
FIG. 1 shows a three-dimensional view, from above, of one embodiment of a rail system for a firearm, in accordance with the invention.
FIG. 1A shows the part A in FIG. 1.

In the drawings, reference numeral 10 generally indicates one embodiment of a rail system for a firearm, in accordance with the invention.

An example of such a firearm is an assault rifle, such as an AR-15 or an M4A1, or their recreational replicas, such as replica gel blasters. However, the rail system 10 will find use with a range of firearms that make use of rail systems.

The rail system 10 includes an elongate body in the form of a tubular body 12 that is mountable to a receiver 14 (FIG. 13) of the firearm so that a barrel 11 (shown truncated in FIG. 14) of the firearm is at least partially enclosed by the body 12. In this example, the barrel 11 extends through the tubular body 12. It is envisaged that, instead of the body 12 being tubular, the body 12 may have other configurations, such as opposed, generally planar sidewalls, a used for handguards on a variety of assault rifles. Such sidewalls can be separate components, that are detachable from each other.

The tubular body 12 has a plurality of openings 13 for weight reduction and heat transfer. The tubular body 12 has a length that suits the firearm to which it is to be mounted. For example, the tubular body 12 can have a length of between approximately 200 mm and 400 mm, for example 330 mm. This range is selected to cover platforms for regular assault rifles, or replicas thereof, such as the AR-15, with either full-size or shortened barrels, up to target or sniper weapon systems. Internal and external diameters of the tubular body 12 can be determined by the application and the firearm to which the tubular body 12 is to be fixed. It will be appreciated that the internal diameter needs to be sufficient to provide enough spacing to facilitate heat dissipation as well as to accommodate a gas block, such as a low profile gas block. Furthermore, the external diameter needs to be sufficient to provide enough space for the mounting of attachments or ancillary devices, via the mounting assembly and ribs, as described below. For example, the internal diameter can be between approximately 32 mm and 36 mm, for example, approximately 35 mm. The external diameter can be between 36 mm and 40 mm, for example, 38 mm.

The rail system 10 includes an elongate mount in the form of a rail 16. The rail 16 can be a picatinny rail or some other rail. The rail 16 extends along and operatively upwardly from the tubular body 12. Also, it is envisaged that the rail system 10 need not necessarily include the rail 16 and can be supplied as a handguard, in accordance with the invention.

Figure 5:
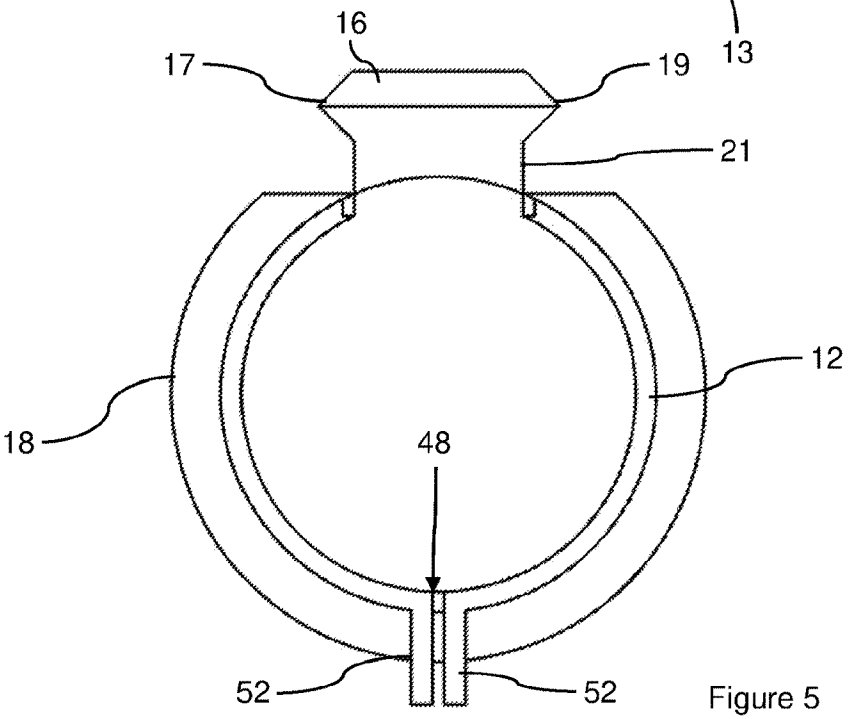
FIG. 5 shows a proximal end view of the rail system of FIG. 1.

The rail 16 has an elongate mount 17 that extends from one end of the tubular body 12 to an opposite end of the tubular body 12. In transverse cross section, the elongate mount 17 has a head portion 19 and a shank portion 21 interposed between the head portion 19 and the tubular body 12 (see FIG. 5), such that the mount 17 is undercut, allowing an ancillary device or attachment to be slid onto the mount 17 and into a desired position. The head portion 19 defines a series of equally spaced slots 23 that extends along a length of the head portion 19, to allow the ancillary device or attachment to be secured in the desired position. The slots 23 have a width of between approximately 5 mm and 6 mm, for example 5.25 mm, which is the conventional slot size for picatinny rails.

Figure 2:
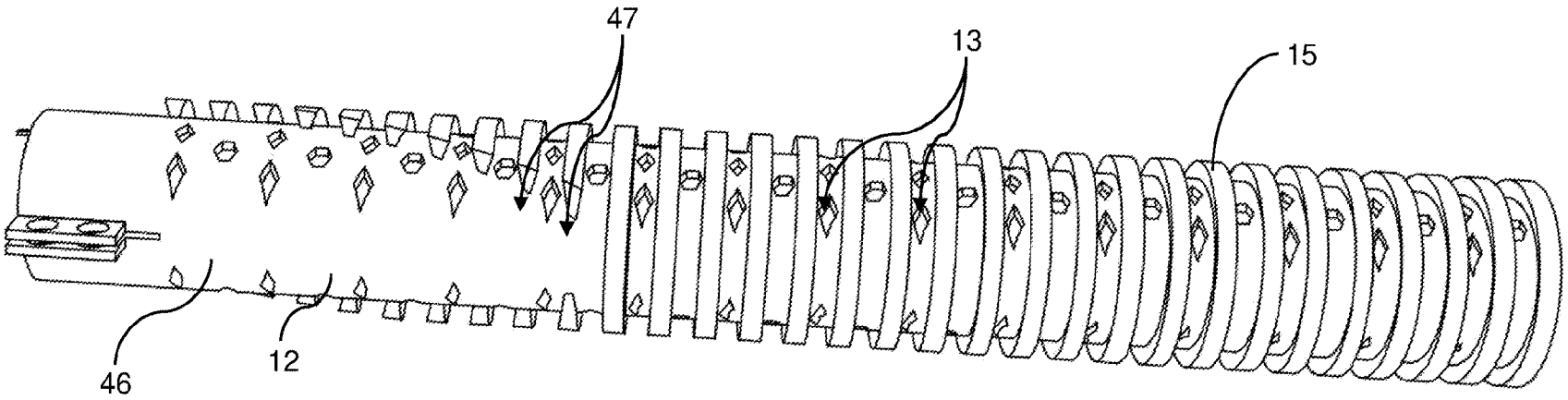
FIG. 2 shows a three-dimensional view, from below, of the rail system of FIG. 1.
Figure 3:
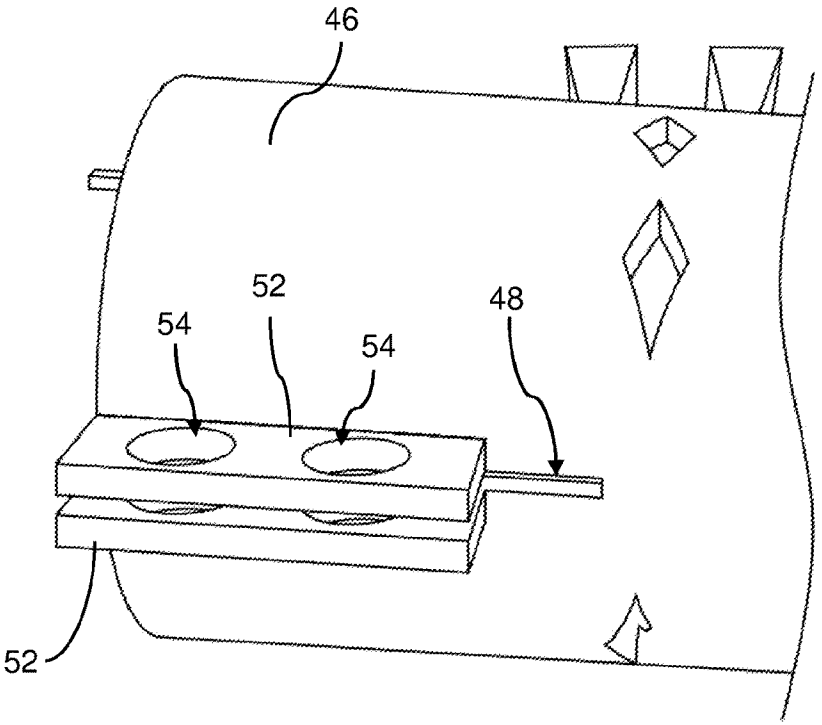
FIG. 3 shows a detailed view, from below, of a proximal portion of the rail system of FIG. 1.
Figure 4:
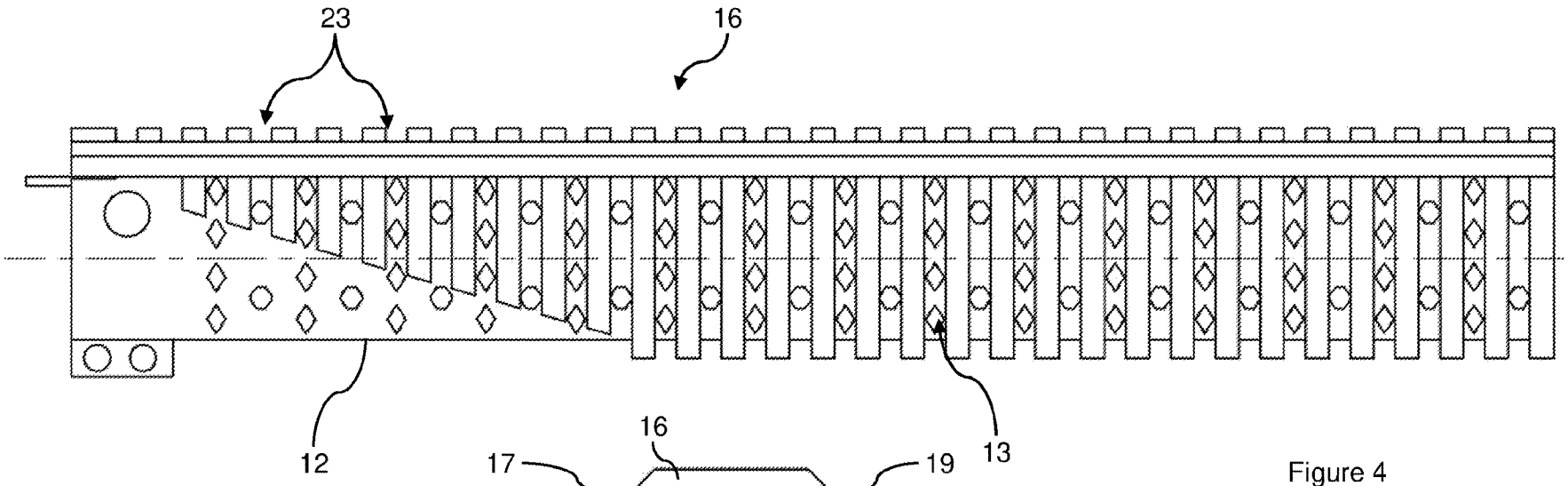
FIG. 4 shows a side view of the rail system of FIG. 1.

The tubular body 12 can have various cross sectional profiles. In this example, the body 12 is generally cylindrical. A series of substantially parallel, circumferential mounting ribs 18 is arranged on, and projects laterally or outwardly from, the tubular body 12. The ribs 18 extend from at or near each side of the mount 17 and at least partially about the body 12. Thus, the tubular body 12 and the ribs 18 define a handguard 15, in accordance with the invention, for the firearm. The rail 16 is interposed between, and spaced from, opposite ends 40 of the ribs 18. The ribs 18 can extend through approximately 300° from one side of the rail 16 to the other side of the rail 16. The mounting ribs 18 have central gaps 47 (FIG. 2) that increase in size towards a proximal end portion 46. The reason for this is that it is unlikely that ancillary devices or attachments will be mounted at that location and the gaps 47 allow for weight saving.

The rail system 10 includes one or more mounting assemblies 20 (FIGS. 6-8) for attachments or ancillary devices for the firearm. The mounting assembly 20 is fastenable between at least two consecutive mounting ribs 18. The mounting assembly 20 is releasably engageable with the mounting ribs 18 so that a position of the mounting assembly 20 on the tubular body 12 can be circumferentially and infinitely adjusted. The mounting assembly 20 is configured so that the ancillary device can be mounted to the rail system via the mounting assembly 20, in a detachable manner.

Each mounting rib 18 has an outward facing surface 22 and opposed sides 24 that taper towards each other from the surface 22 to the tubular body 12 such that a space 26 between consecutive ribs 18 converges from the tubular body 12 to the outward facing surfaces 22 of the ribs 18. Thus, the space 26 has a generally dovetailed radial profile.

The spaces 26 can be aligned with the slots 23 of the rail 16. The surface 22 of each rib 18 can have a width of between approximately 4 mm and 6 mm, for example, 5 mm. A width of each rib 18 at the tubular body 12 can be between approximately 1.5 mm and 2.5 mm, for example, 2 mm. A spacing between the ribs 18, at the surface 22, can be between approximately 5 mm and 6 mm, for example, 5.25 mm. A height of each rib 18 can be between approximately 4 mm and 4.5 mm, for example, 4.3 mm.

Figure 7:
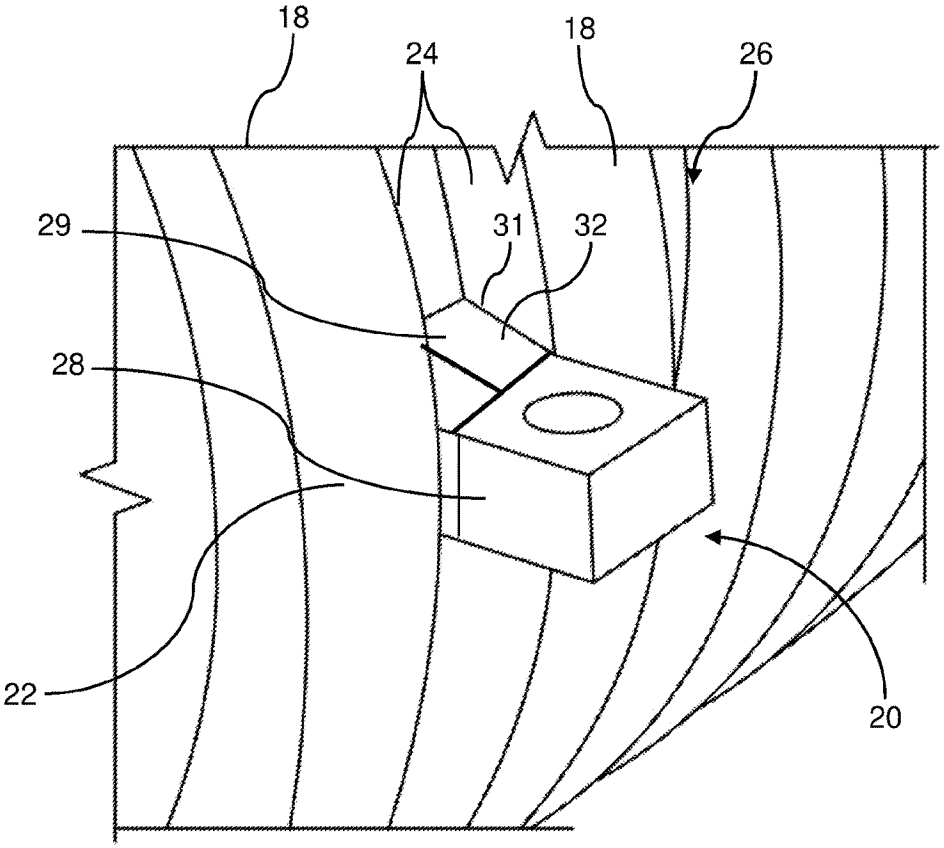
FIG. 7 shows a detailed view of part of the rail system, showing the mounting assembly in position.
Figure 6:
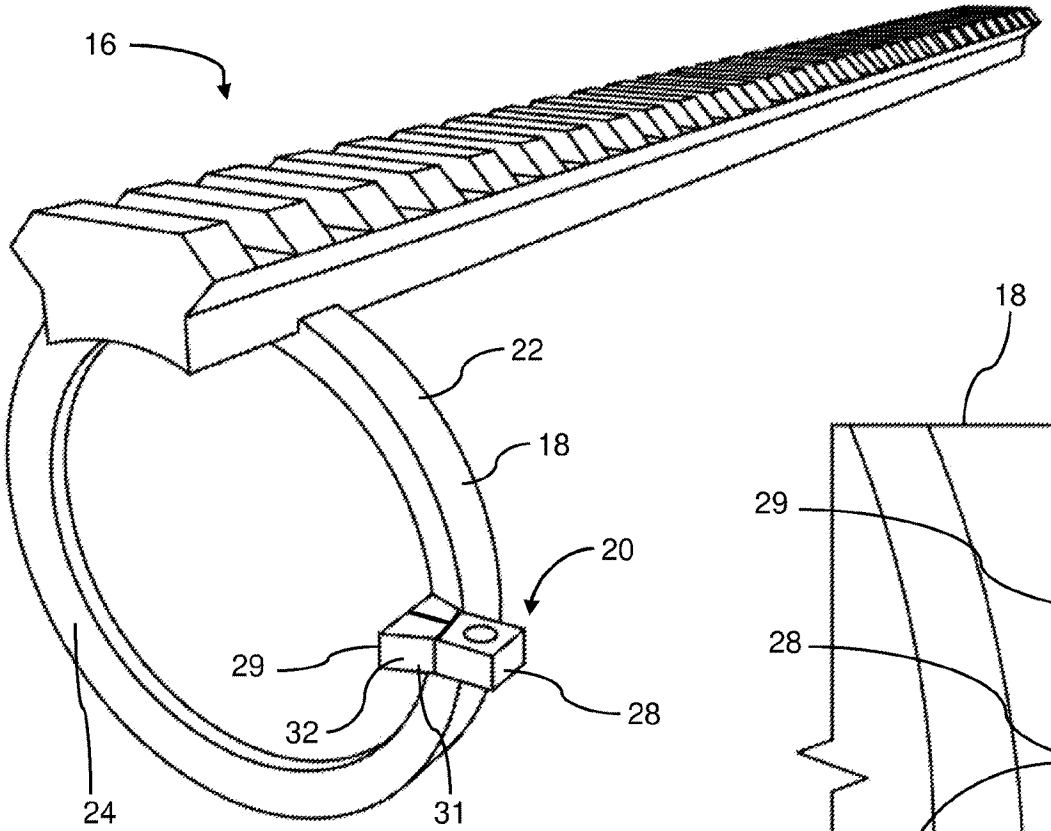
FIG. 6 shows a schematic view of part of the rail system of FIG. 1, illustrating one example of a mounting assembly for use with the rail system.
Figure 8:
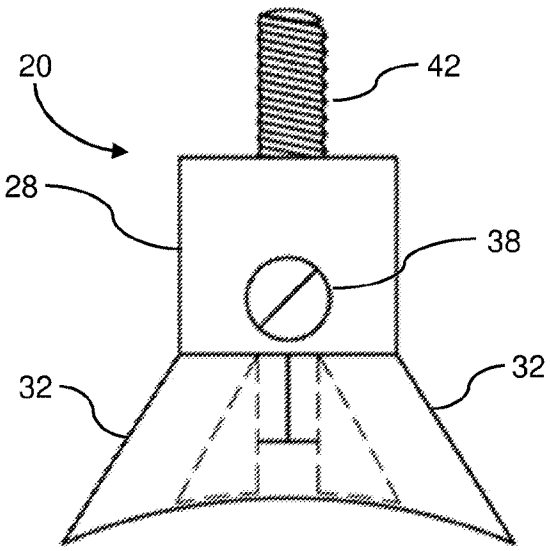
FIG. 8 shows a schematic, plan view of the mounting assembly.

Various forms of mounting assembly 20 can engage the ribs 18. An example of the mounting assembly 20 is shown in FIGS. 6 to 8. The mounting assembly 20 can include a mount 28 to which attachments or ancillary devices, such as rail sections or rail segments (described below with reference to a further embodiment) can be releasably connected. The mount 28 is arranged on a connector 29 that extends from the mount 28 and can be received in the space 26. The mount 28 can be arranged on more than one connector 29. The connector 29 is adjustable between a fixed condition in which the connector 29 engages the facing sides 24 of the consecutive ribs 18, defining the space 26, to lock the mounting assembly 20 in an operative position, and a released or loosened condition in which the connector 29, and thus the mounting assembly 20 can slide to and fro within the space 26 for infinite positional adjustment.

The mounting assembly 20 can include any of several fastening mechanisms that are operatively engaged with the connector 29 and operable to expand or displace the connector 29 so that the connector 29 can bear against the ribs 18 to be secured to the ribs 18 or be released from the ribs 18. For example, the fastening mechanism can engage the connector 29 and displace it towards the body 12, away from the mount 28, into a released or loosened condition so that the mounting assembly 20 can slide to and fro within the space 26, for infinite adjustment of a position of the connector in the space 26, or displace it away from the body 12, towards the mount 28, into a secured or tightened condition so that the mounting assembly 20 is substantially secured or locked to the ribs 18 in an operative position.

The connector 29 includes opposed distal and proximal faces 31. The faces 31 are generally planar and extend angularly and outwardly from the mount 28 so that the connector 29 and the spaces 26 have corresponding radial profiles. The faces 31 correspond with the sides 24 of the ribs 18 so that the connector 29 can nest between the ribs 18, with the faces 31 either in sliding engagement with the sides 24, in the loosened condition, or bearing against the sides 24, in the tightened or secured condition. Thus, the connector 29 and the ribs 18 are dimensioned so that the connector 29 is inhibited from lateral movement out of the associated space 26.

The connector 20 includes two legs 32 that define the faces 31. The legs 32 are displaceable relative to the mount 28 to move between the tightened condition, shown in solid lines in FIG. 8, and the loosened condition, shown in dotted lines in FIG. 8. It is to be understood that FIG. 8 is schematic.

Various fastening mechanisms for engaging the mount 28 and the connector 29 may be operable to displace the connector 29 outwardly and towards the mount 28 into the fastened or secured condition, and away from the mount 28 into the loosened or released conditions. Thus, the fastening means displaces the legs 32 relative to the mount 28 to achieve the tightened or secured and loosened or released conditions referred to above.

Figure 9:
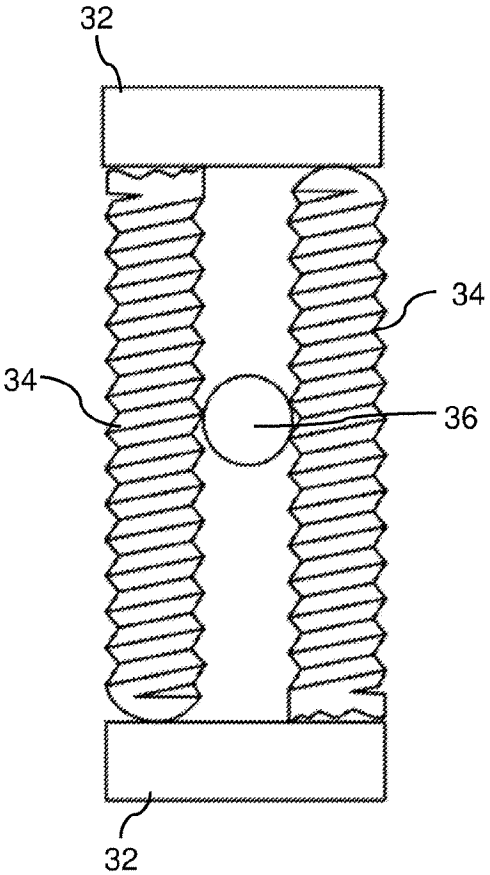
FIG. 9 shows a schematic view of part of the mounting assembly of FIG. 8 with legs of the mounting assembly in a retracted condition.
Figure 10:
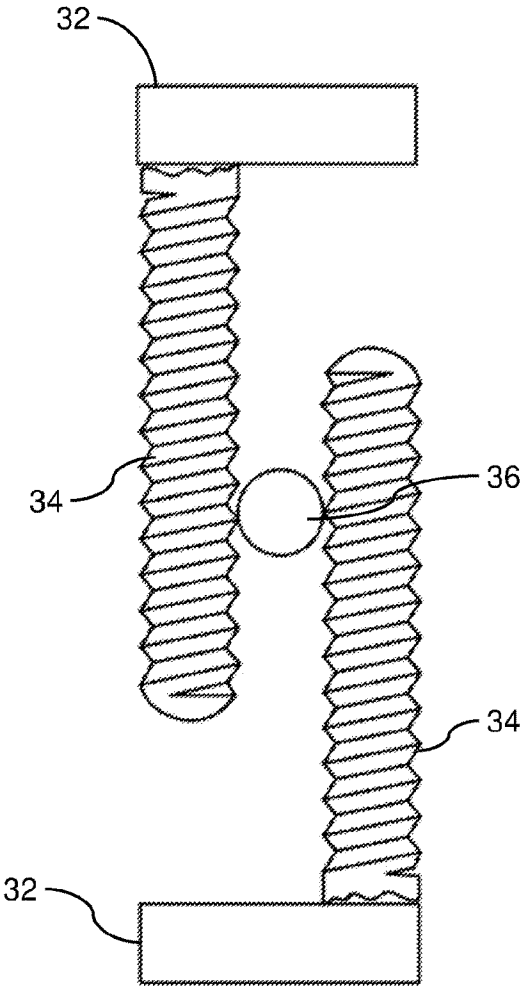
FIG. 10 shows a schematic view of part of the mounting assembly of FIG. 8 with legs of the mounting assembly in an extended condition.

FIGS. 9 and 10 show, schematically, an example of how such displacement of the legs 32 might be achieved. In this case, the fastening mechanism includes two power or drive screws 34 that are in abutment with respective legs 32. A cog or gear 36 is interposed between, and meshed with, the screws 34 so that rotation of the gear 36 results in displacement of the drive screws 34 in opposite directions. As a result, the legs 32 can also be displaced in opposite directions between the tightened and loosened conditions depending on the way in which the gear 36 is rotated. The gear 36 is operatively connected to an operating screw 38 so that it can be operated with a conventional tool, such as a screwdriver to achieve rotation of the gear 36.

Ends 40 of the ribs 18 are spaced from the rail 16 so that the mount 28 can be removed from the space 26 and located in a different space 26, depending on requirements.

Each rib 18 can include a positional marker(s), for example, at a 90° location, for convenience.

As can be seen in FIG. 8, and not shown in FIGS. 6 and 7, a threaded shank 42 extends from the mount 28. The threaded shank 42 allows a rail segment, for example, to be screwed onto the mount 28. It will be appreciated that two or more of the threaded shanks 42 can correspond with two or more openings in one rail segment to secure that rail segment to the ribs 18. The rail segments allow attachments or ancillary devices to be mounted on the handguard 15, in a conventional manner. Other forms of connection, different to the threaded shank 42, could be arranged on the mount 28, depending on requirements. Furthermore, devices other than the rail segments can be fastened to the mount 28.

Figure 14:
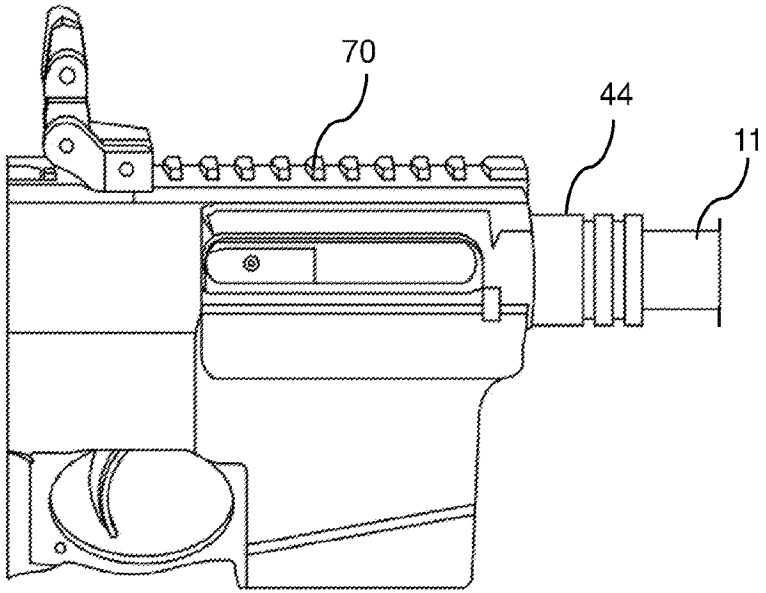
FIG. 14 shows a side view of the receiver with the barrel nut screwed onto the receiver.

The rail system 10 includes a cylindrical barrel nut 44 that can be screwed onto a threaded connector 45 of the receiver 14, in a conventional manner, as shown in FIG. 14, such that the proximal end portion 46 of the tubular body 12 can be fastened to the cylindrical barrel nut 44, for example, as described below. The barrel nut 44 includes a proximal portion 49 with an internal thread 51 that threads onto the connector 45.

The proximal end portion 46 of the tubular body 12 has a slot 48 that opens at a proximal end 50 of the tubular body 12. Two mounting members are arranged on the proximal end portion 46 to project from respective sides of the slot 48. A fastening mechanism is arranged on the mounting members to draw the mounting members together, such that the slot 48 at least partially closes, so clamping the proximal end portion 46 of the tubular body 12 to the barrel nut 44. The mounting members are in the form of mounting plates 52 arranged on the proximal end portion 46 to project from respective sides of the slot 48. The fastening mechanism includes two screw holes 54 in each mounting plate 52, in register with each other, so that suitable fasteners can be received through the holes 54 to draw the mounting plates 52 towards each other.

Figure 12:
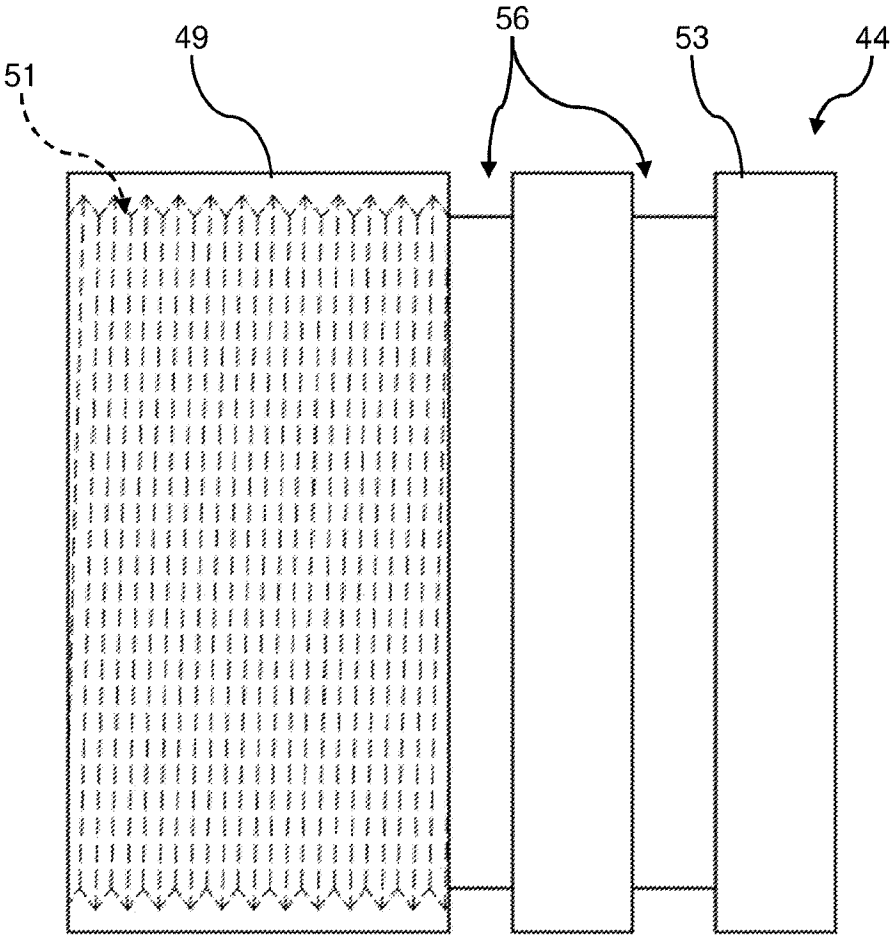
FIG. 12 shows a side view of the barrel nut of FIG. 11.
Figure 11:
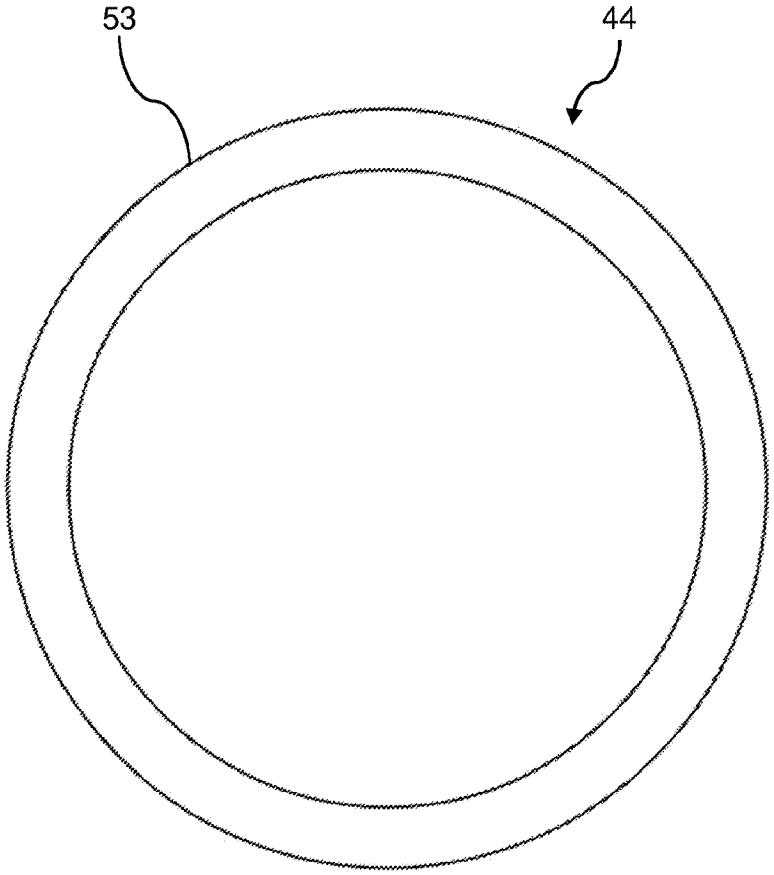
FIG. 11 shows a distal end view of a barrel nut for the rail system of FIG. 1.

The barrel nut 44 has two circumferential grooves or recesses 56 (FIG. 12, 17) in a distal portion 53.

The system 10 includes a torque plate 58 (FIGS. 16-19). The torque plate 58 is generally flat and has a predetermined thickness. The torque plate 58 has two locators 60 that project from a body 62 of the torque plate 58. The locators 60 and the recesses 56 are dimensioned so that the locators 60 can be received, respectively, in the recesses 56. The locators 60 can have a width of between approximately 3 mm and 5 mm, for example, 4 mm. The spacing between the locators can be between approximately 4 mm and 6 mm, for example, 5 mm. The width and spacing of the recesses 56 are such that the locators 60 can be snugly fitted in the recesses 56 with minimal play. However, such fitting is not an interference fit, such that the rail system 10 can be fitted without specialised equipment.

The body 62 of the torque plate 58 has two holes 64 that correspond with the screw holes 54, so that they can be brought into register with the holes 54 when the body 62 is interposed between the mounting plates 52.

Figure 19:
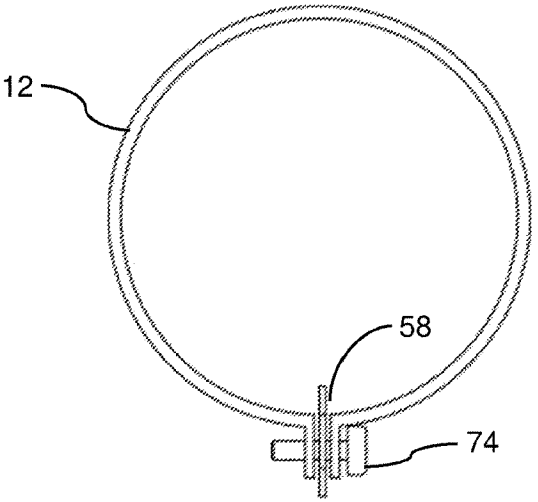
FIG. 19 shows a schematic, proximal end view of the rail system in a fitted or installed condition.
Figure 18:
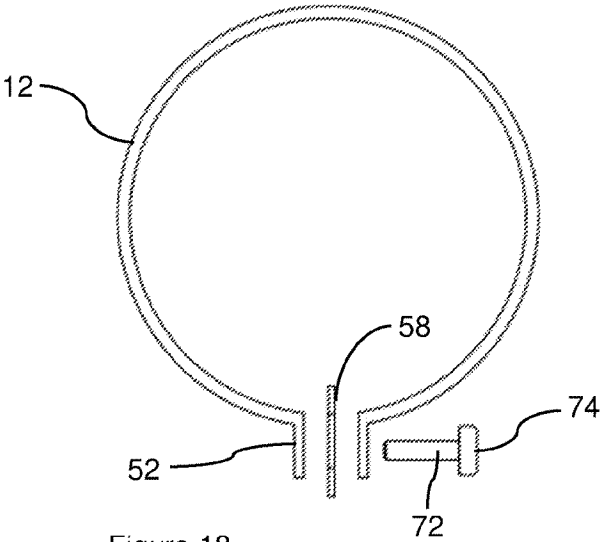
FIG. 18 shows a schematic, proximal end view of the rail system in a loosened condition, prior to fitment or installation.

In use, the barrel nut 44 is secured to the receiver 14 in a conventional manner. For example, manufacturers of the AR-15 specify a required Foot Pound or Newton Metre torque value. Thus, a torque wrench can be used to secure the barrel nut 44 to the receiver 14. The proximal end portion 46 of the tubular body 12 is then positioned over the barrel nut 44. The torque plate 58 is positioned between the mounting plates 52 with the locators 60 positioned in the recesses 56. Shanks 72 of fasteners 74 are received, respectively, through aligned holes 54 and the associated holes 64 (FIG. 18). The fasteners 74 are then tightened to draw the mounting plates 52 towards each other, as shown in FIG. 19. The barrel nut 44 is not shown in FIGS. 18 and 19 for the purposes of clarity. It will be appreciated that the thickness of the torque plate 58 determines the extent to which the mounting plates 52 can be drawn together. This can inhibit over-clamping of the tubular body 12 to the barrel nut 44. Furthermore, the locators 60 in the recesses 56 serve to inhibit excessive linear movement of the tubular body 12 relative to the receiver 14. The fasteners 74 can be any suitable fasteners which would be appropriate for use with assault rifles, considering the recoil and intended use of the assault rifle.

A handle formation 66 extends from the body 62, oppositely to the locators 60. The handle formation 66 facilitates manipulation of the torque plate 58.

Figure 13:
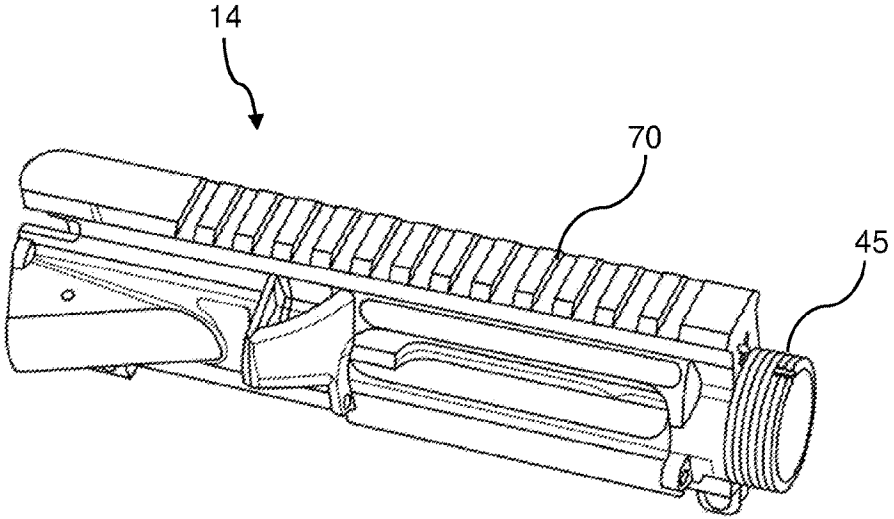
FIG. 13 shows a three-dimensional view, from above, of part of a receiver of a firearm, to which the rail system of FIG. 1 can be fastened.
Figure 15:
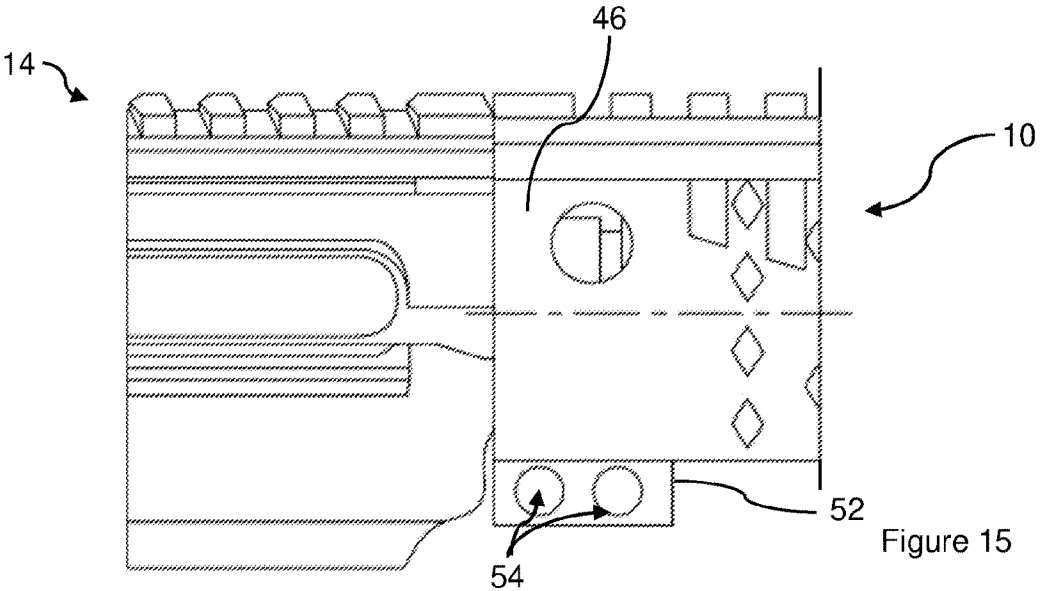
FIG. 15 shows part of the receiver with the rail system of FIG. 1 fastened to the receiver.
Figure 17:
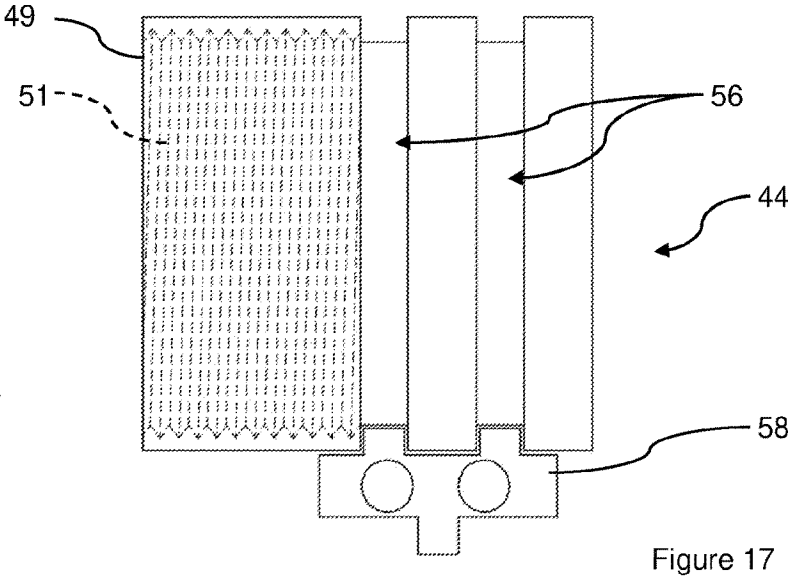
FIG. 17 shows a side view of the torque plate of FIG. 16 engaged with the barrel nut.
Figure 16:
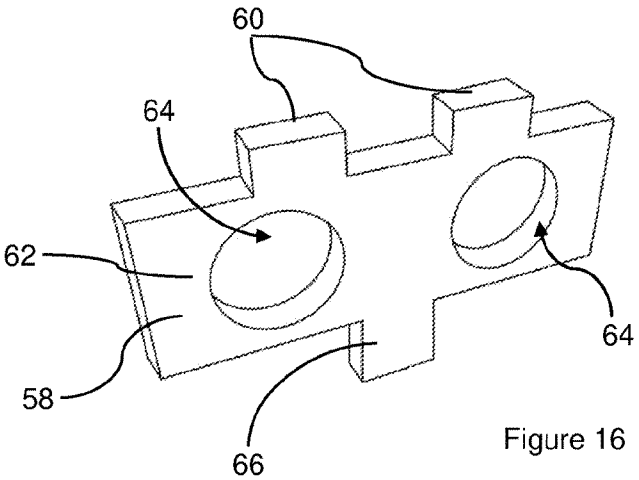
FIG. 16 shows a side view of a torque plate for facilitating location of the rail system of FIG. 1 relative to the receiver.

The rail system 10 includes an anti-twist mechanism to engage with the receiver 14 so as to inhibit excessive twisting of the tubular body 12 relative to the receiver 14. The anti-twist mechanism includes two anti-twist stabilising members or rods 68 (FIG. 1) that extend from the proximal end 50 of the tubular body 12 to be positioned on respective sides of the receiver 14 when the rail system 10 is fitted to the receiver 14. The rods 68 are positioned to engage respective sides of a rail 70 of the receiver 14 (FIG. 13).

The tubular body 12, ribs 18 and mounting assembly 20 can be of a variety of different appropriate materials including steel and aluminium. In one example, these components are machined from 6061 aluminium and anodised with a hard coating.

In FIGS. 20 to 23, reference numeral 100 generally indicates another embodiment of a rail system, in accordance with the invention, for a firearm. With reference to the preceding drawings, like reference numerals refers to like parts, unless otherwise specified. Such use of common reference numerals is not intended to indicate that the commonly numbered parts are identical. Furthermore, where practicable, the parts of the rail system 10 are interchangeable with the parts of the rail system 100. Also, characteristics and features described above in connection with the rail system 10, and below in connection with the rail system 100 can be interchangeable. Thus, it is envisaged that an embodiment of a rail system, in accordance with the invention could include a combination of parts, features and characteristics drawn from the rail system 10 and the rail system 100.

The rail system 100 is suitable for use with the firearms and replicas referred to above, with reference to the rail system 10.

Figure 30:
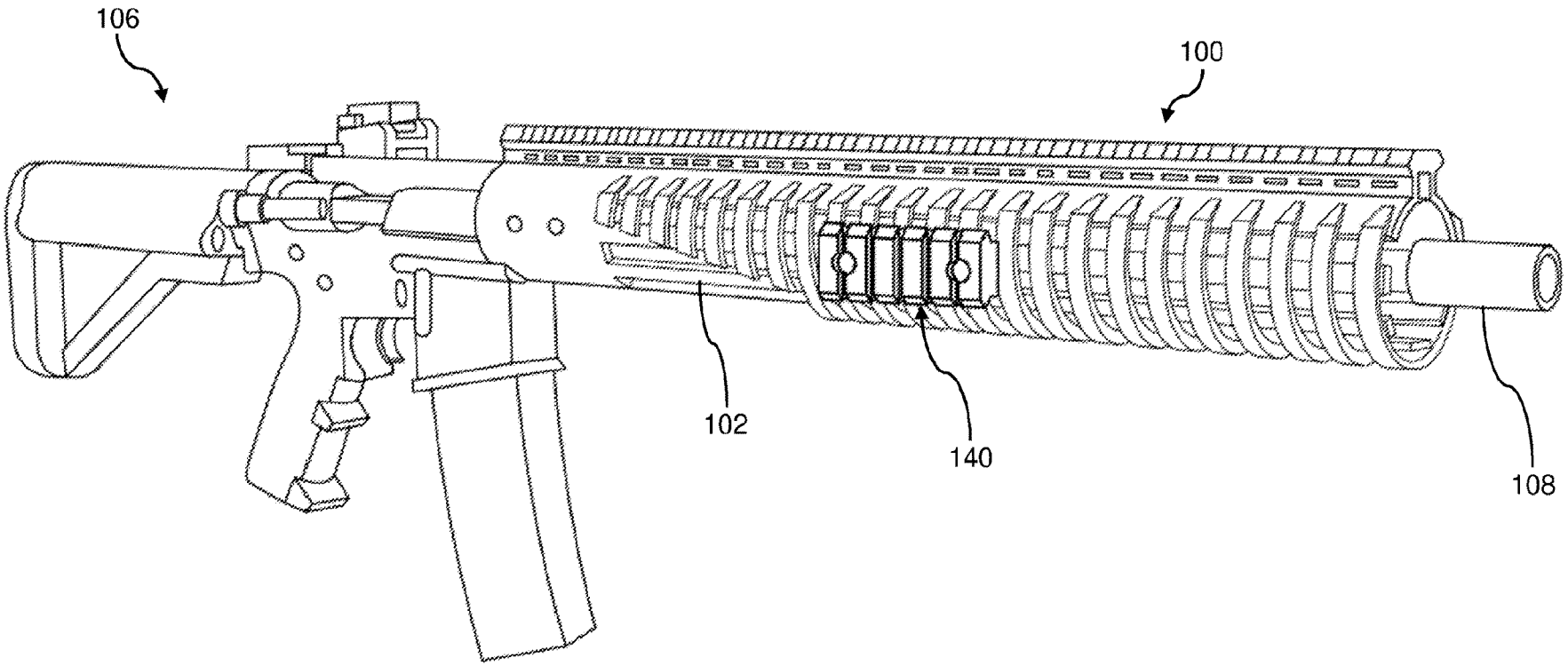
FIG. 30 shows the rail system of FIG. 20, mounted on a firearm.

The rail system 100 includes an elongate body in the form of a tubular body 102 that is mountable to a receiver 104 (FIG. 24) of a firearm, in the form of a rifle 106 (FIG. 30), for example, to at least partially enclose a barrel 108 (FIG. 30) of the firearm. In this example, the barrel 108 extends through the tubular body 102. It is envisaged that, instead of the body 102 being tubular, the body 102 may have other configurations, such as opposed, generally planar sidewalls, a used for handguards on a variety of assault rifles. Such sidewalls can be separate components, that are detachable from each other.

The tubular body 102 can have a length of between approximately 200 mm and 400 mm, for example 330 mm. This range is selected to cover platforms for regular assault rifles, or replicas thereof, such as the AR-15, with either full-size or shortened barrels, up to target or sniper weapon systems. Other lengths may be applicable, depending on the firearm in question.

The tubular body 102 can have various cross-sectional profiles depending, for example, on the firearm with which the rail system 100 is intended to be used. In this example, the body 102 is generally cylindrical with internal and external diameters of the tubular body 102 being determined by the application and the firearm to which the tubular body 102 is to be fixed. It will be appreciated that the internal diameter needs to be sufficient to provide enough spacing to facilitate heat dissipation as well as accommodate a gas block, such as a low profile gas block. Furthermore, the external diameter needs to be sufficient to provide enough real estate for the mounting of attachments or ancillary devices, via the mounting assembly and ribs, as described below. For example, the internal diameter can be between approximately 32 mm and 36 mm, for example, approximately 35 mm. The external diameter can be between 36 mm and 40 mm, for example, 38 mm.

The rail system 100 includes a mount, in the form of a rail 110, that can be a picatinny rail or have a picatinny rail configuration, that extends along and operatively upwardly from the tubular body 102. Other forms of rail may also be suitable, depending on the firearm and its application. Also, it is envisaged that the rail system 100 need not necessarily include the rail 110 and can be supplied as a handguard, in accordance with the invention.

The rail 110 has an elongate mount 112 that extends from one end of the tubular body 102 to an opposite end of the body 102 and projects laterally from the body 102. In transverse cross section, the elongate mount 112 has a head portion 114 and a shank portion 116 interposed between the head portion 114 and the tubular body 102, such that the mount 112 is undercut, allowing an ancillary device or attachment to be slid onto the mount 112 and into a desired position. The head portion 114 defines a series of equally spaced slots 118 that extends along a length of the head portion 114, to allow the ancillary device or attachment to be secured in the desired position. The slots 118 have a width of between approximately 5 mm and 6 mm, for example 5.25 mm. The rail 110 can be a rail, such as a picatinny rail, or some other rail.

The tubular body 102 includes a proximal portion 120 and a distal portion 122. A series of circumferential mounting ribs 124 is arranged on, and projects laterally or outwardly from, the tubular body 102. Thus, the mounting ribs 124 and the tubular body 102 together define one embodiment of a handguard 127, in accordance with the invention, for the rifle 106.

The ribs 124 extend from at or near each side of the rail 110 and at least partially about the body 102. The rail 110 is interposed between, and spaced from, opposite ends 126 of the ribs 124. The ribs 124 can extend through approximately 300° from one side of the picatinny rail 110 to the other side. As can be seen, the mounting ribs 124 have central gaps 125 that increase in size towards the proximal end portion 122. The reason for this is that it is unlikely that ancillary devices will need to be mounted at that location and the gaps 125 allow for weight saving.

The tubular body 102 defines an elongate top slot 128. The shank portion 116 includes spaced legs 130 (FIG. 21) that extend from respective edges of the slot 128. The legs 130 and the head portion 114 together define a channel 132 that opens at the top slot 128 in communication with an interior of the tubular body 102. The channel 132 is dimensioned to accommodate a gas block and gas tube of the rifle 106.

The legs 130 each define a series of slotted openings 133 along their lengths. This assists in optimising a weight of the system 100 and also facilitates the dissipation of heat.

The distal portion 122 defines a series of longitudinally extending slots 134 that are symmetrically arranged relative to a plane that bisects the mount 112. This serves to optimise a weight of the tubular body 102. Thus, the mounting ribs 124 and the distal portion 122 define an array of openings 136 for facilitating the dispersal of heat from the barrel 108.

The rail system 100 includes one or more mounting assemblies 140 (FIGS. 26 to 29) for attachments or ancillary devices for the rifle 106. The mounting assembly 140 is fastenable to at least two consecutive mounting ribs 124 (shown in FIG. 27). The mounting assembly 140 is releasably engageable with the mounting ribs 124 so that a position of the mounting assembly 140 on the tubular body can be circumferentially and infinitely adjusted. The mounting assembly 140 is configured so that the ancillary device can be detachably mounted to the rail system via the mounting assembly 140.

Each mounting rib 124 has an outward facing surface 142 and opposed sides 144 that taper towards each other from the surface 142 towards the tubular body 102 such that a space 146 between consecutive ribs 124 converges from the tubular body 102 to the outward facing surfaces 142 of the ribs 124.

The ribs 124 can be the same as the ribs 18 of the system 10. Thus, the mounting assembly 20 can be used with the system 100 in the manner described above and the mounting assembly 140 can be used with the system 10, as described below.

The spaces 146 can be aligned with the slots 118 of the rail 110. The surface 142 of each rib 124 can have a width of between approximately 4 mm and 6 mm, for example, 5 mm. A width of each rib 124 at the tubular body 102 can be between approximately 1.5 mm and 2.5 mm, for example, 2 mm. A spacing between the ribs 124 can be between approximately 5 mm and 6 mm, for example, 5.25 mm, at the surface 142. A height of each rib 124 can be between approximately 4 mm and 4.5 mm, for example, 4.3 mm.

The mounting assembly 140 includes an elongate mount 148 for releasable connection to an attachment or ancillary device. The elongate mount 148 can be in the form of a rail segment. In transverse cross section, the mount 148 has a head portion 150 and a shank portion 152 depending from the head portion 150. As with the rail 16, the mount 148 is undercut, allowing an ancillary device or attachment to be slipped onto the mount 148 and into a desired position. The head portion 150 defines a series of equally spaced slots 154 that extend along a length of the head portion 150, to allow the ancillary device or attachment to be secured in the desired position. The slots 154 have a width of between approximately 5 mm and 6 mm, for example 5.25 mm. The mount 148 can have a configuration of a conventional picatinny rail or any other rail. The head portion 150 has an overall transverse width of between 19 mm and 23 mm, for example 21.2 mm. The head portion 150 has opposed side surfaces 156, that define outwardly projecting, opposed apices 158. A transverse width of the shank portion 152 is between 13 mm and 17 mm, for example 15.7 mm. A lower surface 160 of the shank portion 152 has an arcuate transverse profile that corresponds with a curvature of the outward facing surfaces 142 of the ribs 124. This facilitates sliding of the mount 148 over the ribs 124.

The mounting assembly 140 includes two connectors 164. The mount 148 is arranged on the connectors 164 so that the connectors 164 can connect the mount 148 to the ribs 124. Each connector 164 includes a body 166 with opposed proximal and distal faces 168, opposed side faces 170, and top and bottom faces 172. The side faces 170 are planar and parallel to each other. The proximal and distal faces 168 are planar and extend angularly away from each other from the top face 172 to the bottom face 172. The top and bottom faces 172 are parallel and arcuate, with a curvature that corresponds with that of the lower surface 160 of the shank portion 152 so that the connector 164 can nest against the shank portion 152. The arcuate bottom face 172 facilitates sliding of the connector 164 in the space 146 along a surface of the body 102. A radial thickness of the connector 164 between the top and bottom faces 172 is between approximately 4 mm and 5 mm, for example, 4.38 mm. In use, the connector 164 is ground before fitment to ensure that the connector 164 fits properly in the space 146 and can slide smoothly with respect to the body 102. Thus, in use, the dimensions of the connector 164 can vary from those provided above at the time of fitment.

A fastening mechanism engages the mount 148 and the connectors 164 and is operable to displace the connectors 164 outwardly and towards the mount 148 into the fastened or secured condition, and away from the mount 148 into the loosened or released condition. The fastening mechanism includes a threaded opening 174 that extends centrally through the connector 164. The mount 148 defines two passages 176 that each have a countersunk portion 178 opening at slots 154 at respective ends of the mount 148 and corresponding with respective threaded openings 174 in the connectors 164. The fastening mechanism includes fasteners 180 are receivable through the passages 176 with heads 182 of the fasteners being receivable in the countersunk portions 178 and threaded shanks 184 extending from the heads 182 and configured for screwing into respective threaded openings 174 such that fastening or tightening rotation of the fasteners 180 drives the connectors 164 towards the mount 148, into a fastened or tightened condition shown in FIG. 27, to secure the connector 164, and thus the mount 148, to consecutive mounting ribs 124 defining the space 146, and loosening of the fasteners 180 releases the connectors 164 from the mounting ribs 124 into a released or loosened condition, for infinite adjustment of a position of the connectors 164 in the space 146.

Figure 27:
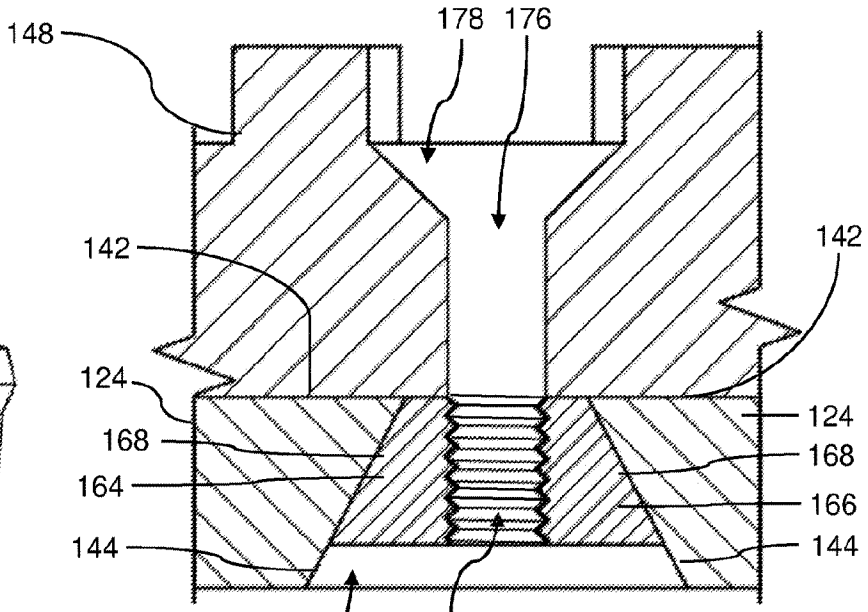
FIG. 27 shows a sectioned view, taken through A-A in FIG. 26, of part of the mounting assembly of FIG. 26 to illustrate fastening of the mounting assembly to ribs of the rail system.
Figure 29:
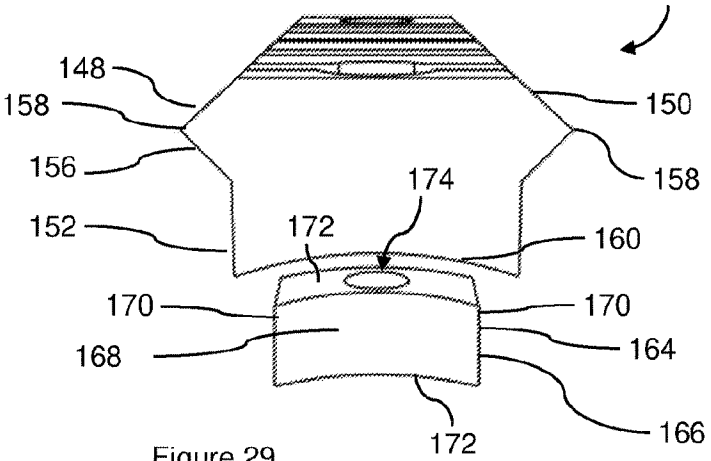
FIG. 29 shows an end view of the mounting assembly of FIG. 26.
Figure 26:
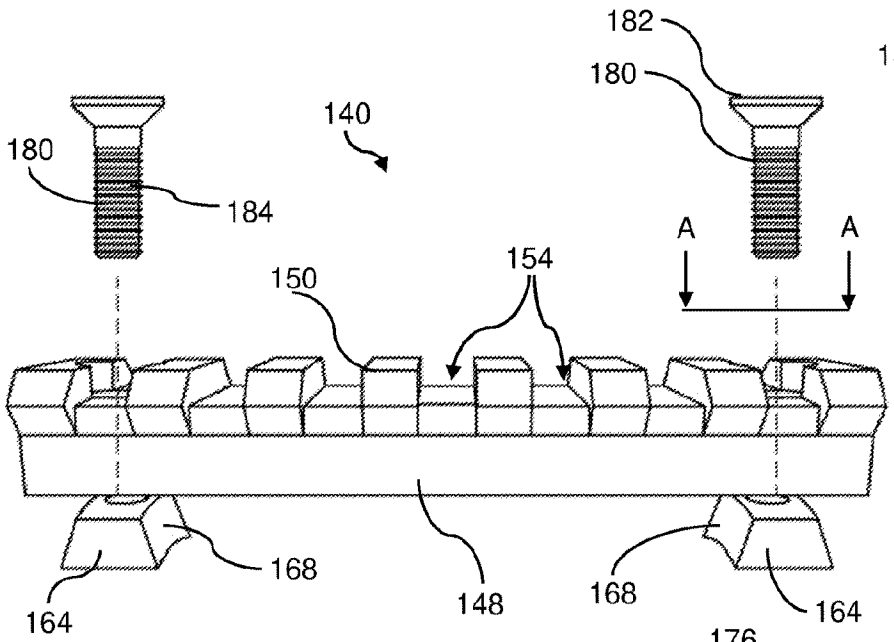
FIG. 26 shows an exploded side view of a mounting assembly for use with the rail system of FIG. 20.
Figure 28:
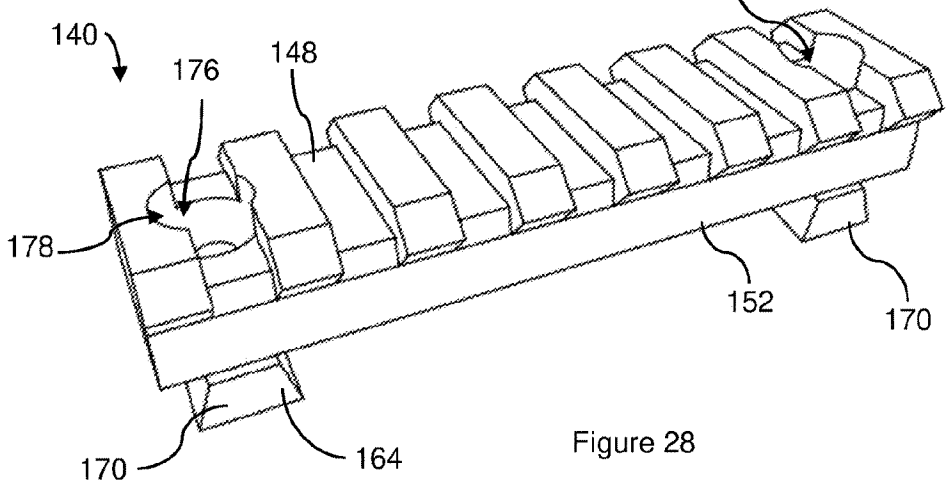
FIG. 28 shows a three-dimensional view, from above, of the mounting assembly of FIG. 26.

In the loosened condition, the body 166 is slidably receivable between consecutive ribs 124 with the proximal and distal faces 170 in nesting relationship with facing sides 144 of the consecutive ribs 124. It will be appreciated that radial or lateral displacement of the body 166 from the ribs 124 is inhibited due to the converging space 146, as described above. Thus, the body 166 is movable towards the tubular body 102 to allow the body 166 to slide between the consecutive ribs 124 and movable away from the tubular body 102 to lock the body 166, into the tightened condition, against the facing sides 144 of the consecutive ribs 124 due to the converging facing sides 144 of the consecutive ribs 124. The tightened condition is illustrated in FIG. 27. Thus, the connectors 164 and the ribs 124 are dimensioned so that the connectors 164 are inhibited from lateral movement out of the associated space 146.

Figure 20:
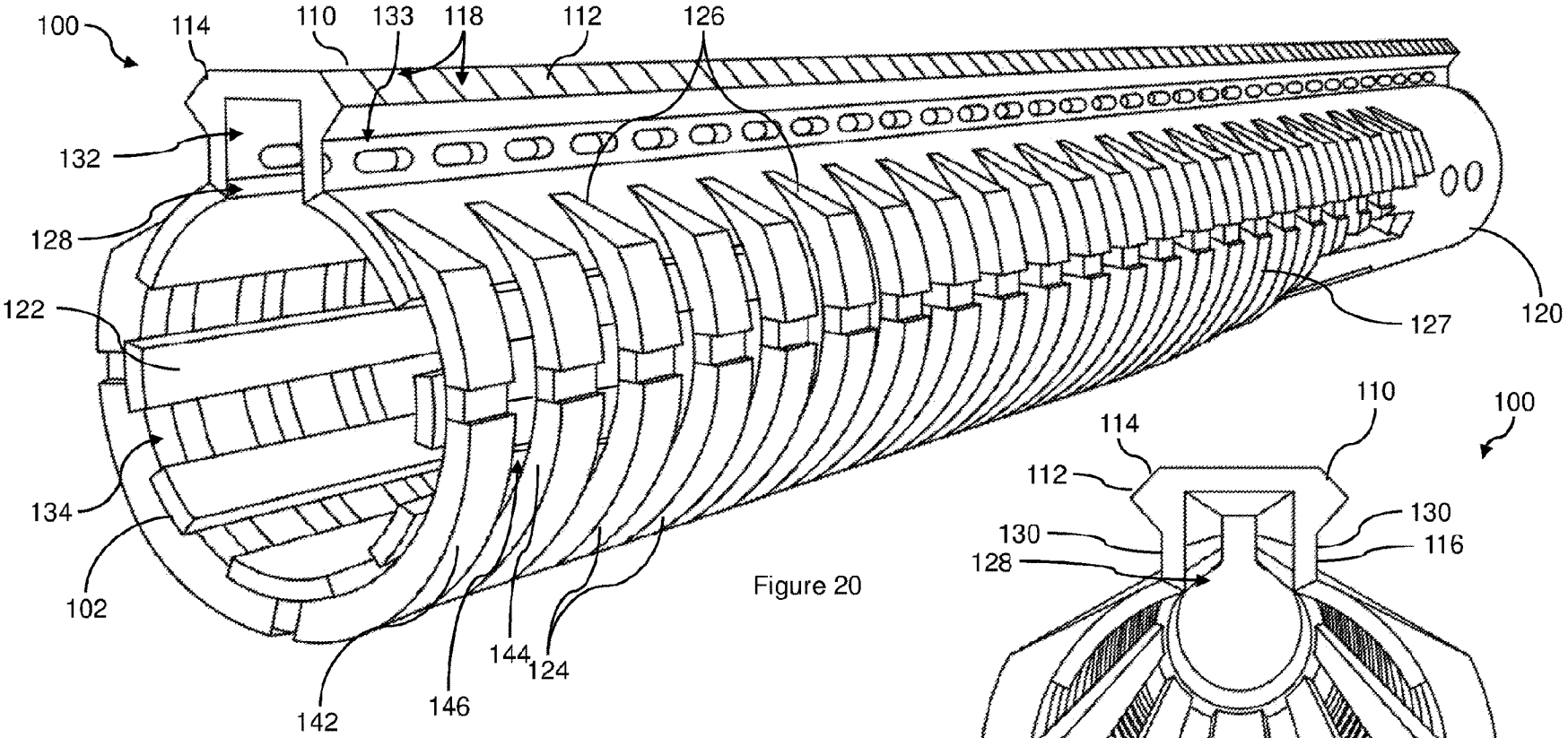
FIG. 20 shows a distal, three-dimensional view of another embodiment of a rail system for a firearm, in accordance with the invention.
Figure 21:
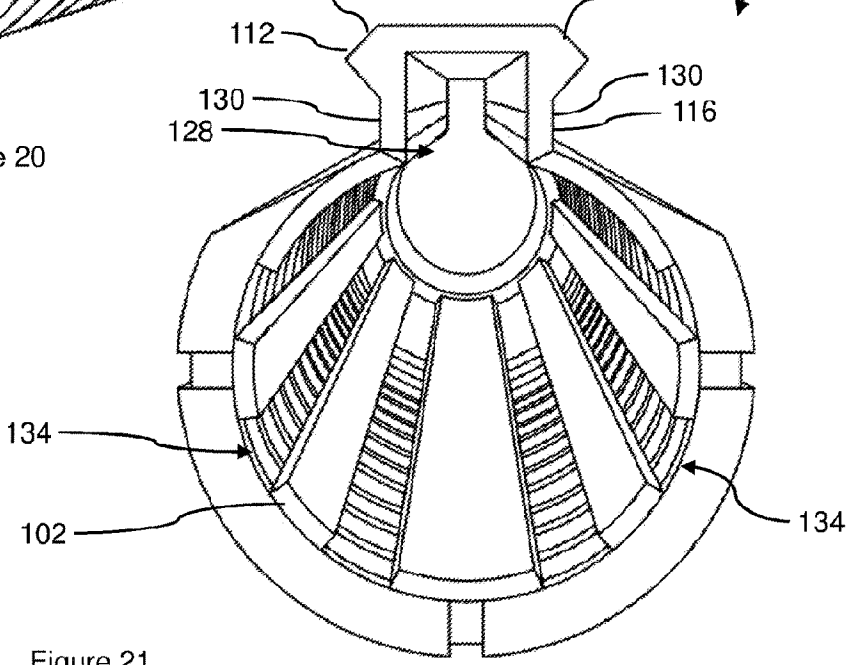
FIG. 21 shows a distal end of the rail system of FIG. 20.
Figure 22:
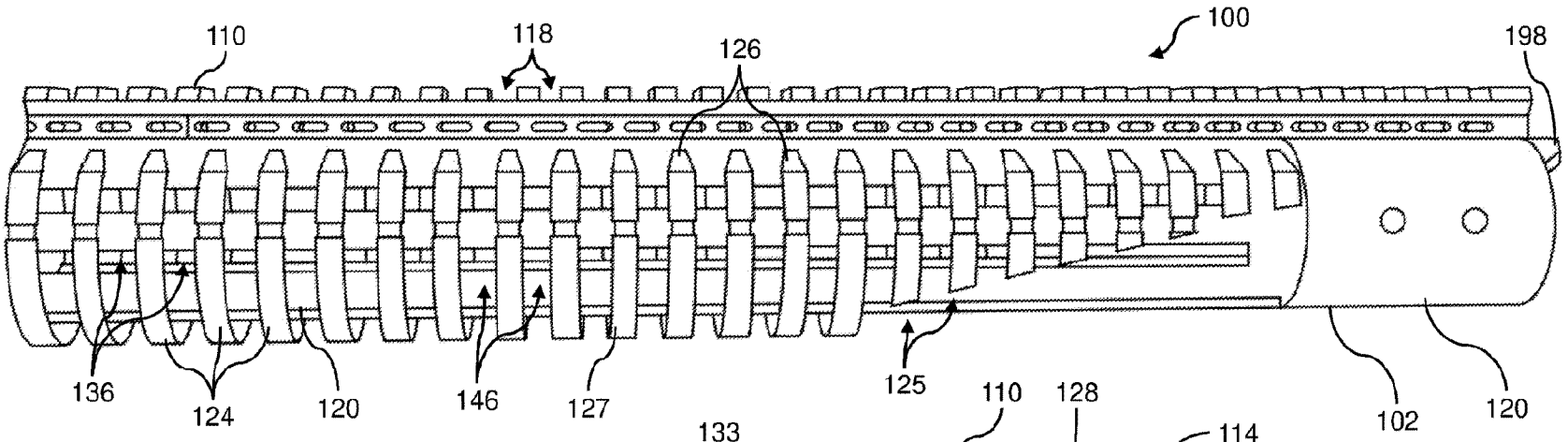
FIG. 22 shows a side view of the rail system of FIG. 20.

As can be seen in FIGS. 20-22, the opposite ends 126 of the ribs 124 terminate at a position spaced from the rail 110. Furthermore, the ends 126 slope downwardly with respect to the rail 110. This allows the connectors 164, while connected to the mount 148, to be slidably received in respective spaces 146. Thus, with the fasteners 180 loosened, the mount 148 can be slid into its desired position. When the fasteners 180 are tightened, they serve to drive the connectors 164 towards the mount 148 so that the mount 148 can be locked into position.

Figure 24:
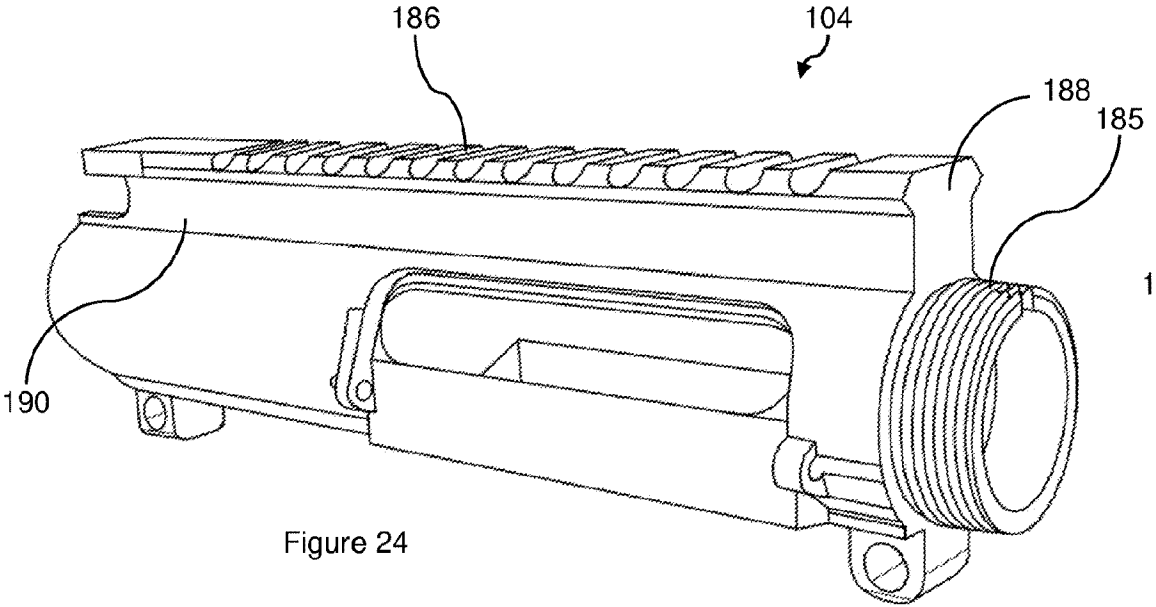
FIG. 24 shows a receiver of a firearm on which the rail system of FIG. 20 can be mounted.

In FIG. 24, there is shown the receiver 104 of the rifle 106. The receiver 104 is a conventional receiver. As such, it has a threaded mount 185 at a distal end. The receiver 104 also includes a rail 186 with a transverse, external profile that is similar to that of the rail 110. Thus, the rail 186 includes a head portion 188 and a shank portion 190. These are brought into alignment with the head portion 114 and the shank portion 116 of the rail 110 when the rail system 100 is mounted on the rifle 106.

The rail system 100 includes a barrel nut 192. The barrel nut 192 has an internal thread 193 that corresponds with that of the threaded mount 185. Thus, the barrel nut 192 can be fastened to the receiver 182 by being screwed onto the mount 185. The barrel nut 192 includes an internal shoulder 195 that terminates the internal thread so that the mount 185 and the barrel nut 192 can be properly located relative to each other. The barrel nut 192 defines evenly and circumferentially spaced pairs of threaded openings 194. The openings 194 of each pair are spaced from each other along a line that is parallel to a longitudinal axis of the barrel nut 192.

Figure 23:
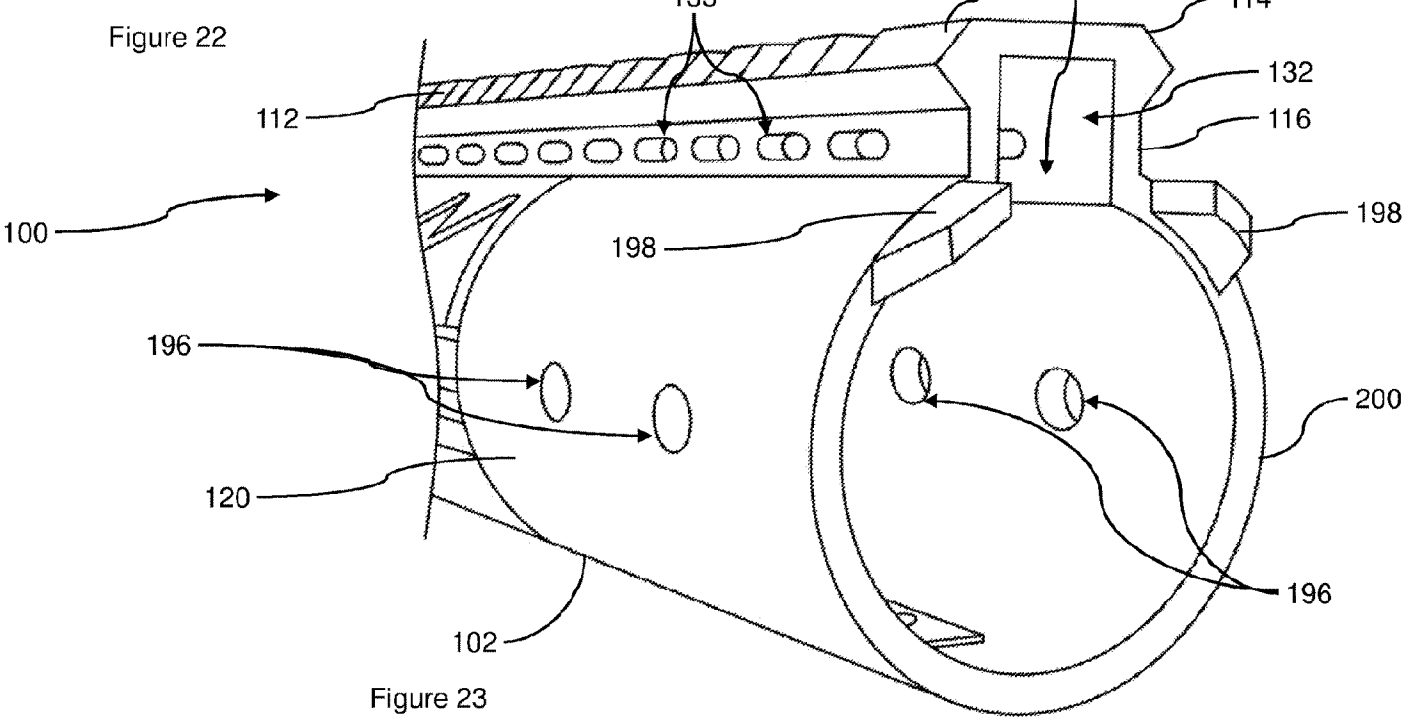
FIG. 23 shows a proximal view of the rail system of FIG. 20.
Figure 25:
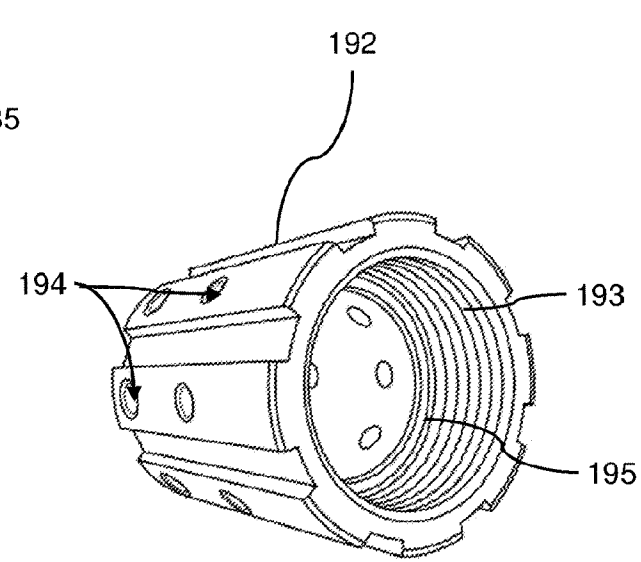
FIG. 25 shows a barrel nut of the rail system of FIG. 20, for fastening the rail system to the receiver of FIG. 24.

The proximal portion 120 of the tubular body 102 can be slidably received over the barrel nut 192 once the barrel nut 192 is fastened to the receiver 182. The proximal portion 120 defines opposed pairs of openings 196 (FIG. 23). The openings 196 of each pair are spaced from each other along a line that is parallel to a longitudinal axis of the proximal portion 120. The openings 194, 196 are positioned so that, when the proximal portion 120 of the tubular body 102 is positioned on the barrel nut 192, each pair of openings 196 can be brought into register with two corresponding pairs of the openings 194. The circumferential spacing of the pairs of openings 194 allows for variations in turns of the barrel nut 192 for tightening. Thus, suitable fasteners can be used to fasten the tubular body 102 to the barrel nut 192 so that the rail system 100 is fastened to the rifle 106.

As shown in FIGS. 22 and 23, circumferentially spaced anti-twist projections 198 project from a proximal end 200 of the proximal portion 120. The projections 198 extend from each side of the shank portion 116, slightly offset from the shank portion 116. Thus, when the proximal portion 120 is engaged with the barrel nut 192, as described above, the shank portion 190 of the receiver 182 is interposed between the projections 198. Thus, the projections 198 inhibit rotation or twisting of the tubular body relative to the receiver 182.

The material used for the fabrication of the rail system 100 can be the same as that used for the rail system 10, as described above.

As set out about, it is envisaged that the rail system 10, 100 can be provided as a handguard, in accordance with the invention.

The rail system 10, 100 encompasses an attachment and/or ancillary device mounting arrangement that can provide operators with the ability to adjust the position of attachments and ancillary devices with sub-millimetre-level precision. The fact that the mounting assembly 20, 140 can slide and lock within the circumferential spaces 26, 146 facilitates continuous adjustment of the position of each attachment or ancillary device on the rail system 10, 100 to suit a particular operator. This can significantly improve ergonomics and can allow the operator to use their firearm for greater lengths of time due to the increased comfort. Furthermore, the need to purchase adapters for customised location of ancillary devices or attachments can be significantly obviated.

The rail system 10, 100 is simple to use. Longitudinal adjustment simply required the selection of appropriate pairs of ribs, while rotational adjustment can be achieved by a simple sliding motion, until a desired position is reached. With the system 100, the two fasteners 180 can then be tightened and the relevant ancillary device or attachment secured in position.

The rail system 10, 100 can be fitted to a firearm, such as the rifle 106, in the manner described above, without the need for an armourer or gunsmith.

The appended claims are to be considered as incorporated into the above description.

Throughout this specification, reference to any advantages, promises, objects or the like should not be regarded as cumulative, composite and/or collective and should be regarded as preferable or desirable rather than stated as a warranty.

Throughout this specification, unless otherwise indicated, "comprise," "comprises," and "comprising," (and variants thereof) or related terms such as "includes" (and variants thereof)," are used inclusively rather than exclusively, so that a stated integer or group of integers may include one or more other non-stated integers or groups of integers.

When any number or range is described herein, unless clearly stated otherwise, that number or range is approximate. Recitation of ranges of values herein are intended to serve as a shorthand method of referring individually to each separate value falling within the range, unless otherwise indicated herein, and each separate value and each separate subrange defined by such separate values is incorporated into the specification as if it were individually recited herein.

Words indicating direction or orientation, such as "front", "rear", "back", etc, are used for convenience. It is envisaged that various embodiments can be used in a non-operative configuration, such as when presented for sale. Thus, such words are to be regarded as illustrative in nature, and not as restrictive.

The word "proximal" is used to indicate an orientation with respect to an operator or user. That is, it refers to an end or a portion which is closer to the operator or user than an opposite end or remaining portion. The word "distal" is used in an opposite sense to the word "proximal".

Features which are described in the context of separate aspects and embodiments of the invention may be used together and/or be interchangeable. Similarly, features described in the context of a single embodiment may also be provided separately or in any suitable sub-combination.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

The invention claimed is:

1. A rail system for a firearm, the rail system comprising:
an elongate body that is fastenable to the firearm to at least partially enclose a barrel of the firearm;
a series of substantially parallel mounting ribs projecting laterally from the elongate body, each mounting rib having an outward facing surface and opposed sides that taper towards each other from the outward facing surface to the elongate body, such that a space between consecutive mounting ribs converges from the elongate body to the outward facing surfaces of the mounting ribs; and
at least one mounting assembly for an attachment or ancillary device for the firearm, the, or each, mounting assembly including:
at least one connector that is receivable in one of the spaces between the consecutive mounting ribs;
a fastening mechanism operatively engaged with the, or each respective, connector, and operable to secure the connector to the consecutive mounting ribs or to release the connector from the mounting ribs for infinite adjustment of a position of the connector in the space between the consecutive ribs; and
a mount arranged on the, or each, connector, the mount being configured for releasable connection to the attachment or ancillary device.

2. The rail system as claimed in claim 1, wherein the elongate body is tubular.

3. The rail system as claimed in claim 2, which includes an elongate mount arranged longitudinally on the elongate body and projecting laterally from the elongate body.

4. The rail system as claimed in claim 3, wherein the ribs extend from at or near each side of the mount and at least partially about the elongate body.

5. The rail system as claimed in claim 1, wherein the, or each, connector and the ribs are dimensioned so that the connector is inhibited from lateral movement out of the space between the consecutive ribs.

6. The rail system as claimed in claim 1, wherein the, or each, connector includes a body that has opposed side faces, top and bottom faces and opposed proximal and distal faces, the proximal and distal faces being planar and extending angularly away from each other from the top face to the bottom face, with the proximal and distal faces being complementary with the side of each mounting rib so that outward displacement of the connector from a loosened position to a fastened position results in the proximal and distal faces bearing against facing sides of the consecutive mounting ribs such that, in the loosened position, the connector can slide between the consecutive mounting ribs, and, in the fastened condition, sliding of the connector between the consecutive mounting ribs is inhibited.

7. The rail system as claimed in claim 6, wherein the fastening mechanism engages the mount and the, or each, connector, and is operable to displace the, or each, connector outwardly and towards the mount into the fastened condition, and away from the mount into the loosened position.

8. The rail system as claimed in claim 7, wherein the, or each, connector defines a threaded opening and the mount defines at least one passage that corresponds with the threaded opening, the fastening mechanism including at least one threaded fastener that is receivable through the, or each respective, passage and into the threaded opening to engage the connector so that tightening rotation of the fastener serves to draw the connector towards the mount, into the fastened condition, so that the proximal and distal faces of the connector bear against the facing sides of the consecutive mounting ribs and loosening rotation of the fastener releases the proximal and distal faces of the connector from the facing sides, into the released condition.

9. The rail system as claimed in claim 8, wherein the mount is in the form of an elongate rail segment.

10. The rail system as claimed in claim 1, wherein the tubular body is cylindrical.

11. The rail system as claimed in claim 10, which includes a cylindrical barrel nut that can be screwed onto a receiver of the firearm, a proximal end portion of the tubular body being fastenable to the cylindrical barrel nut.

12. The rail system as claimed in claim 11, wherein the cylindrical barrel nut includes at least one radially extending threaded opening and the proximal end portion of the tubular body defines at least one respective corresponding opening so that the tubular body can be secured to the barrel nut with a suitable threaded fastener.

13. The rail system as claimed in claim 1, wherein the tubular body includes an anti-twist mechanism to engage with a receiver of the firearm so as to inhibit excessive twisting of the tubular body relative to the receiver.

14. The rail system as claimed in claim 13, in which the anti-twist mechanism includes two anti-twist projections that extend from a proximal end of the tubular body to be positioned on either side of a rail of the receiver.

15. A rail system for a firearm, the rail system comprising:
an elongate body that is fastenable to the firearm to at least partially enclose a barrel of the firearm; and
a series of substantially parallel mounting ribs projecting laterally from the elongate body, each mounting rib having an outward facing surface and opposed sides that taper towards each other from the outward facing surface to the elongate body, such that a space between consecutive mounting ribs converges from the elongate body to the outward facing surfaces of the mounting ribs, a connector of a mounting assembly for an attachment or ancillary device for the firearm being receivable in one of the spaces between the consecutive mounting ribs, the mounting assembly including a fastening mechanism operatively engaged with the connector and operable to secure the connector to the consecutive mounting ribs or to release the connector from the mounting ribs for infinite adjustment of a position of the connector in the space between the consecutive ribs, with a mount of the mounting assembly arranged on each connector, the mount being configured for releasable connection to the attachment or ancillary device.

16. A handguard for a firearm, the handguard comprising:
an elongate body that is fastenable to the firearm to at least partially enclose a barrel of the firearm;
a series of substantially parallel mounting ribs projecting laterally from the elongate body, each mounting rib having an outward facing surface and opposed sides that taper towards each other from the outward facing surface to the elongate body, such that a space between consecutive mounting ribs converges from the elongate body to the outward facing surfaces of the mounting ribs; and
at least one mounting assembly for an attachment or ancillary device for the firearm, the, or each, mounting assembly including:
at least one connector that is receivable in one of the spaces between the consecutive mounting ribs;

a fastening mechanism operatively engaged with the, or each respective, connector, and operable to secure the connector to the consecutive mounting ribs or to release the connector from the mounting ribs for infinite adjustment of a position of the connector in the space between the consecutive ribs; and a mount arranged on the, or each, connector, the mount being configured for releasable connection to the attachment or ancillary device.

17. A handguard for a firearm, the handguard comprising:

an elongate body that is fastenable to the firearm to at least partially enclose a barrel of the firearm; and a series of substantially parallel mounting ribs projecting laterally from the elongate body, each mounting rib having an outward facing surface and opposed sides that taper towards each other from the outward facing surface to the elongate body, such that a space between consecutive mounting ribs converges from the elongate body to the outward facing surfaces of the mounting ribs, a connector of a mounting assembly for an attachment or ancillary device for the firearm being receivable in one of the spaces between the consecutive mounting ribs, the mounting assembly including a fastening mechanism operatively engaged with the connector and operable to secure the connector to the consecutive mounting ribs or to release the connector from the mounting ribs for infinite adjustment of a position of the connector in the space between the consecutive ribs, with a mount of the mounting assembly arranged on each connector, the mount being configured for releasable connection to the attachment or ancillary device.

* * * * *